US006801185B2

(12) United States Patent
Salley

(10) Patent No.: US 6,801,185 B2
(45) Date of Patent: Oct. 5, 2004

(54) ILLUMINATED VIEWING ASSEMBLY, VIEWING SYSTEM INCLUDING THE ILLUMINATED VIEWING ASSEMBLY, AND METHOD OF VIEWING THEREFOR

(75) Inventor: Neil B. Salley, Bristol, RI (US)

(73) Assignee: C-360, Inc., Providence, RI (US)

( * ) Notice: Subject to any disclaimer, the term of this patent is extended or adjusted under 35 U.S.C. 154(b) by 78 days.

(21) Appl. No.: 09/834,475

(22) Filed: Apr. 13, 2001

(65) Prior Publication Data

US 2001/0048405 A1 Dec. 6, 2001

Related U.S. Application Data

(60) Provisional application No. 60/197,289, filed on Apr. 14, 2000, provisional application No. 60/217,596, filed on Jul. 11, 2000, and provisional application No. 60/257,850, filed on Dec. 21, 2000.

(51) Int. Cl.[7] ..... G09G 3/36

(52) U.S. Cl. ..... 345/102; 345/1.1; 345/5; 345/7; 345/87; 345/90; 345/169; 345/901; 345/905; 40/502; 40/503; 40/504

(58) Field of Search ..... 345/1.1, 5, 7, 87, 345/90, 102, 901, 905, 169; 40/502, 503, 504

(56) References Cited

U.S. PATENT DOCUMENTS

| | | | | |
|---|---|---|---|---|
| 1,288,145 | A | | 12/1918 | Noville |
| 1,407,498 | A | | 2/1922 | Sutphen |
| 1,470,468 | A | | 10/1923 | Noville |
| 2,068,414 | A | | 1/1937 | Johnson |
| 2,529,151 | A | | 11/1950 | Glass et al. |
| 3,163,554 | A | | 12/1964 | Gessler |
| 3,653,138 | A | | 4/1972 | Cooper |
| 3,863,246 | A | | 1/1975 | Trcka et al. |
| 3,976,837 | A | | 8/1976 | Lang |
| 4,048,739 | A | | 9/1977 | Benton, Jr. |
| 4,158,487 | A | * | 6/1979 | Collender ..... 352/38 |
| 4,160,973 | A | | 7/1979 | Berlin, Jr. |
| 4,760,443 | A | * | 7/1988 | Secka ..... 348/37 |
| 4,853,769 | A | * | 8/1989 | Kollin ..... 348/54 |
| 4,919,383 | A | * | 4/1990 | Benjamin et al. ..... 248/349.1 |
| 4,943,851 | A | | 7/1990 | Lang et al. |

(List continued on next page.)

FOREIGN PATENT DOCUMENTS

| | | | |
|---|---|---|---|
| JP | 4-242786 | | 8/1992 |
| JP | 04242786 | | 8/1992 |
| WO | WO 97/35229 | | 9/1997 |
| WO | WO99/35634 | * | 7/1999 |
| WO | WO 99/35837 | | 7/1999 |

OTHER PUBLICATIONS

Universal Display Corporation, "The Technology of Organic Light Emitting Devices, (<see www.universaldisplay-.com>)," (1998).

Lumitex, Inc., "Information downloaded from website (<see www.lumitex.com>)," (1999).

Invention Connection, "360 Degree Television Technology (<see www.inventionconnection.com>) and (<www.360tv.com>)".

Optical Toys, "Jeu du Thaumatrope," (see <www.optical-toys.com> and <www.opticaltoys.com/jdt.htm>).

*Primary Examiner*—Vijay Shankar
*Assistant Examiner*—Leonid Shapiro
(74) *Attorney, Agent, or Firm*—Lowrie, Lando & Anastasi, LLP

(57) ABSTRACT

A viewing assembly, viewing system, and method of use are provided. The viewing assembly and system and method of use provide images that may be viewed from any position orthogonal to, and from a plurality of positions oblique to, the axis on which a substantially planar viewing assembly may be rotated. The assembly and method allow viewers to view images from any position 360 degrees around the viewing assembly.

20 Claims, 19 Drawing Sheets

U.S. PATENT DOCUMENTS

| | | | | | |
|---|---|---|---|---|---|
| 4,970,812 | A | | 11/1990 | Tanaka et al. | |
| 4,979,026 | A | | 12/1990 | Lang et al. | |
| 5,057,827 | A | | 10/1991 | Nobile et al. | |
| 5,144,328 | A | | 9/1992 | Blake et al. | |
| 5,152,089 | A | | 10/1992 | Bellico | |
| 5,450,094 | A | | 9/1995 | Li et al. | |
| 5,479,153 | A | | 12/1995 | Yi et al. | |
| 5,598,650 | A | | 2/1997 | Brown | |
| 5,657,563 | A | | 8/1997 | Lane | |
| 5,663,740 | A | | 9/1997 | Brotz | |
| 5,703,606 | A | | 12/1997 | Blundell | |
| 5,704,145 | A | | 1/1998 | Hanitz | |
| 5,721,585 | A | | 2/1998 | Keast et al. | |
| 5,782,026 | A | | 7/1998 | Capie | |
| 5,815,314 | A | | 9/1998 | Sudo | |
| 5,818,172 | A | | 10/1998 | Lee | |
| 5,818,401 | A | | 10/1998 | Wang | |
| 5,856,819 | A | * | 1/1999 | Vossler | 345/102 |
| 5,901,484 | A | | 5/1999 | Seder | |
| 5,973,845 | A | | 10/1999 | Hildebrand et al. | |
| 6,018,899 | A | | 2/2000 | Hanitz | |
| 6,037,876 | A | | 3/2000 | Crouch | |
| 6,104,447 | A | * | 8/2000 | Faris | 349/5 |
| 6,282,355 | B1 | * | 8/2001 | Zarian et al. | 385/128 |
| 6,441,930 | B1 | * | 8/2002 | Hart | 359/35 |
| 6,580,422 | B1 | * | 6/2003 | Reilly | 345/169 |

* cited by examiner

ILLUMINATED VIEWING ASSEMBLY, VIEWING SYSTEM INCLUDING THE ILLUMINATED VIEWING ASSEMBLY, AND METHOD OF VIEWING THEREFOR

RELATED CASES

Priority for this application is hereby claimed under 35 U.S.C. §119(e) to commonly owned and co-pending U.S. Provisional Patent Application Nos. 60/197,289 which was filed on Apr. 14, 2000; 60/217,596 which was filed on Jul. 11, 2000; and 60/257,850 which was filed on Dec. 21, 2001; each of which were filed in the name of Salley, Neil B., and each of which is incorporated by reference herein in its entirety.

BACKGROUND

1. Technical Field

The present application is directed to an illuminated viewing assembly, a viewing system including the illuminated viewing assembly, methods of use for both and, in particular, to an illuminated viewing assembly and method of use that provides images that may be viewed from any position orthogonal to, and from a plurality of positions oblique to the viewing assembly.

2. Related Art

There are many instances in which it is desirable to provide a picture or display simultaneously and continuously to a group of people. Examples of such instances include business meetings, at airports and other transportation centers, shopping centers, and anywhere large numbers of people are assembled or congregate. Such displays are difficult to provide when several people wish to view the display simultaneously from a variety of locations, because conventional display systems generally cannot be viewed from the rear or extreme sides. Conventional displays are limited to situations in which a viewer's line of sight is precisely normal to the plane of the picture. Thus, the area from which a viewing audience may be accommodated is limited to locations with suitable sight lines. As a result, use of available space near and around conventional display systems is often limited.

Some attempts to solve this problem have involved displays rotating through 360 degrees. Such displays have permitted several people surrounding the display to view the display. The rotation of such displays must be relatively slow in order to permit the various viewers to have an opportunity to study the display. Such a slow rotation means that essentially only a few people at a time may view the display, while others out of the line of sight must wait until the display comes into their line of sight.

U.S. Pat. No. 3,863,246 to Treka et al. discloses a back lighted display apparatus.

U.S. Pat. No. 3,976,837 to Lang discloses an apparatus for projecting an image onto a rear view screen positioned in a vertical plane which can be rotated extremely rapidly about a vertical axis exactly bisecting the picture in the plane.

U.S. Pat. No. 4,943,851 to Lang et al. discloses a viewing system that includes a liquid crystal display screen including a plurality of LCD panels positioned in a stationary position around a rear projection screen.

U.S. Pat. No. 4,979,026 to Lang et al. discloses a viewing system in which an image is projected from a CRT.

U.S. Pat. No. 5,152,089 to Bellico discloses a multi-image sign display.

Recently, billboards have been displayed that appear to include louvers that allow viewers passing by the billboard to view two different images, depending on the angle at which they pass by the billboard.

There remains a need for improved systems for providing displays that will permit persons located at any position around the display to examine the display substantially simultaneously.

SUMMARY

Historically, cinema-photographic projections are based on projecting a sequence of images in the form of a linear strip of translucent film onto a reflecting screen at a rate that allows the effect of persistence of vision to occur. Persistence of vision is a physiological term that describes how the human brain retains an image cast upon the retina for an instant after the object viewed is removed or changed. The entire concept of cinema is based on the effect of persistence of vision. In cinema, the rapid sequencing of images is provided by a mechanical shutter that closes, advances, aligns, and then reopens to project the film image upon a screen consecutively at a rate higher than the reaction frequency of the human eye.

The present invention utilizes the same principals that form the bases for conventional cinema but in a different arrangement. Images are emitted or reflected from a rotating illuminated viewing assembly, which includes an arrangement of at least one illumination source, at least one image member, and at least one blocking member.

The effect of the blocking member is similar to louvers or venetian blinds whereby narrow strips of light blocking material allow a limited field of view. This field of view can be regulated by the width of the louvers, the distance between the louvers and number of louvers utilized.

As the viewing assembly rotates, the blocking member prevents the viewer from viewing the illuminated image member until the plane of the viewing assembly has rotated to 0 degrees (+ or −24 degrees) of the viewers line of sight. The resulting optical effect is such that as the viewing assembly rotates, the images on both sides of the viewing assembly are presented consecutively without the motion blur that would otherwise be inherent in, for example, a rotating screen. This optical effect is due to the combined effect of the alignment of images on either side of the viewing assembly together with effect of persistence of vision. The optical effect is also affected by the relative thickness of the viewing assembly, i.e., the optical effect is improved as the thickness of the viewing assembly decreases. When viewed at eye level, the perception of rotational movement of the viewing assembly decreases as the distance from the surface of the image member to the axis of rotation is reduced. For example, when viewing the rotating viewing assembly at low speed without the louvers attached, the viewing assembly would appear to repeatedly "grow" from a vertical line until it reaches its full size and then "contract" upon itself. The louvers simply present the illuminated image to the viewer only when it has reached its full size.

Another aspect of the invention is directed to animated imaging, which describes a looped or continuous animation sequence. Animated imaging may be provided by including two images that, when aligned properly in a viewing assembly, are able to create the illusion of perceived motion as the image assembly rotates. One example is the image of a butterfly hovering in mid air as its wings appear in motion, flapping up and down repeatedly. Animated imaging may be provided at predetermined rotation rates at which printed text, graphics, or any combination thereof, may be displayed.

At relatively higher rotational rates, the ability to provide animated imaging is lost. However, at relatively higher rotational rates, the invention may provide flicker-free imaging, which describes the elimination of the stroboscopic effect that otherwise occurs at lower rotational rates. Because the stroboscopic effects are made imperceptible at the higher rotational rates, flicker-free imaging may be used to display printed text, graphics, photographs, or any combination thereof.

It should be noted that the rotation rates of the animated imaging and flicker-free imaging do not necessarily need to remain a constant, and that it may be desirable to change the rotation rate, for example, as part of a presentation, especially if multiple illuminated panels and text are mounted to a single viewing assembly.

Another aspect of the invention is directed to viewing assemblies that include computer and/or video displays. Such displays require rotation rates that are coordinated, and preferably identical to the scan rate of the screens mounted to the assembly. For example, traditional LCD video screens scan at a rate of about 29.97 scans per second. Therefore the screen must rotate at about 29.97 revolutions per second. Scan rates sometimes vary between manufacturers, some manufactures offer screens with adjustable scan rates, and some screens have a "softer" scan than do others. Therefore, a precisely regulated rotational rate is not always critical.

When a viewing assembly is rotating continuously it may be necessary or desirable to shield the viewing assembly from unwanted obstacles such as hands or other means of obstruction and to minimize wind resistance to the surface of the rotating viewing assembly. This may be achieved by enclosing the viewing assembly within a housing constructed from a transparent material such as glass or acrylic. The housing may be mounted coaxially with the axis of rotation of the image assembly, which allows the viewing assembly to rotate freely. At high rotation rates, it may be desirable to create an air vacuum within the cylindrical chamber to eliminate wind resistance.

To improve the contrast and overall visibility of the viewing assembly, it may be necessary or desirable to provide a dark background that blocks the view of structures and lights on the opposite side of the viewing system. This may be accomplished by positioning a layer of polarizing film completely around the viewing system such that the angle of polarization is at 45 degrees to horizontal. In this manner, the polarization angle on any two opposing points on the film will be perpendicular and as a result, will block unwanted light. When a polarizing film is disposed on the interior or exterior of the transparent housing, the effect is that of a constant black background behind the rotating viewing assembly.

By means of a rotating viewing assembly of the type described above that is contained within a transparent housing lined with polarizing material, the invention has the unique ability to present animated imaging, flicker-free imaging, and video or computer generated images. When positioned in the center of a room, this imagery is visible to any number of viewers simultaneously within a 360-degree parameter of the display.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

The present invention is directed to a viewing system and a method of using the system. The viewing system includes a rotatable illuminated viewing assembly that provides an image that may be viewed from any position orthogonal to, and from a plurality of positions oblique to, an axis "a" bisecting the viewing assembly. When the viewing assembly is rotatable, it is preferably rotated about axis "a." The viewing assembly may be rotated about axis "a" at a variety of rotation rates to provide a variety of different optical effects for a viewer, which will be described in greater detail below.

Figure 1:
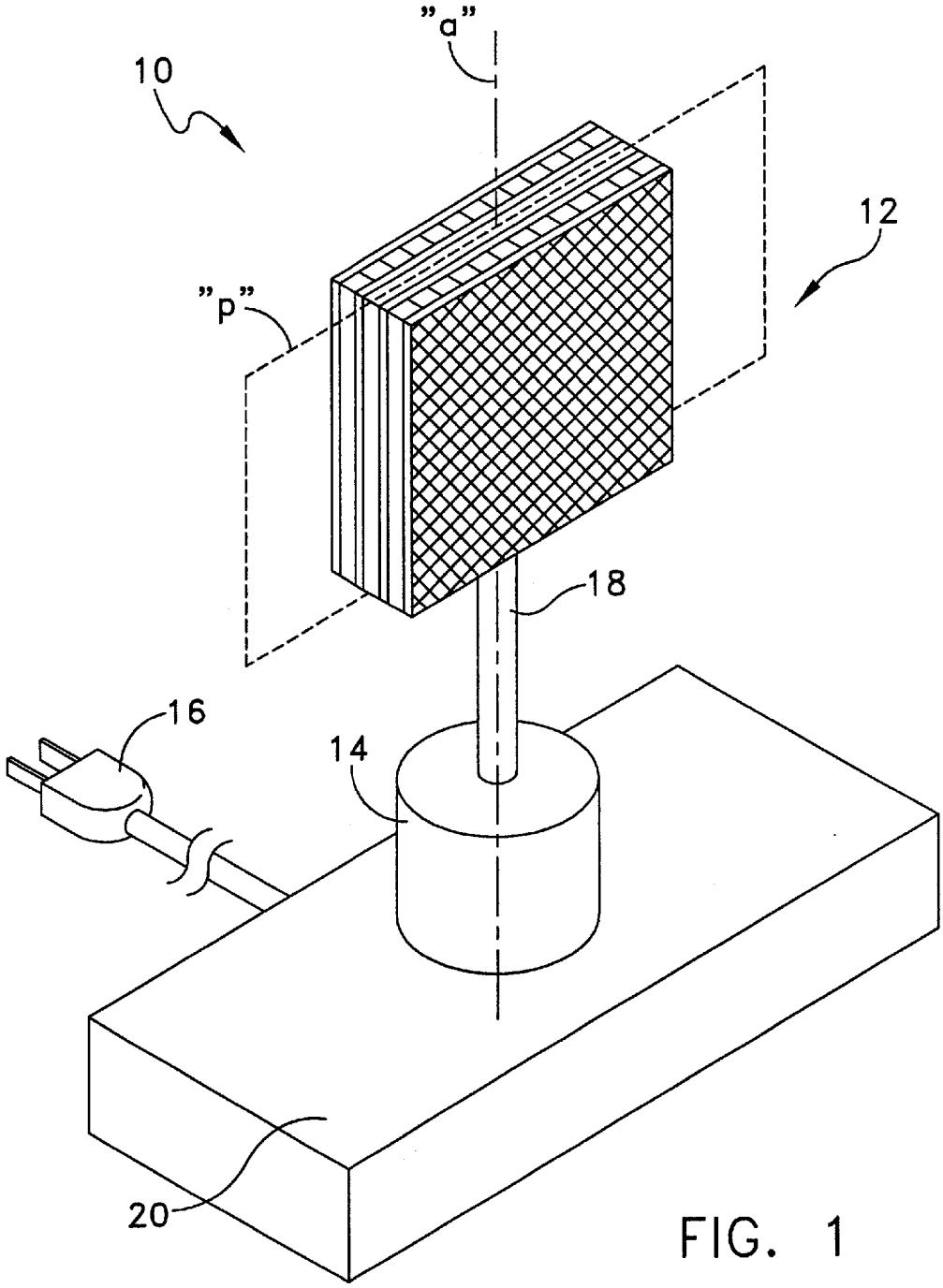
FIG. 1 is a perspective view of one embodiment of a viewing system including a rotatable viewing assembly.

FIG. 1 illustrates a perspective view of one embodiment of the present viewing system 10. Viewing system 10 includes a viewing assembly 12, a means for rotation 14, and a source of power 16 connected to the means for rotation 14, which in the present embodiment is a motor. "Viewing assembly," as used herein, is meant to define any arrangement of at least one illumination source, at least one image member, and at least one blocking member, each of which are defined below. In some embodiments, the viewing assembly may be supported on a support member for rotation. In the present embodiment, viewing assembly 12 is preferably supported by a support member 18 which is connected to the means of rotation 14. A variety of viewing assemblies may be used in any of the viewing systems described herein, some of which are described in greater detail below.

Preferably, support member 18 may be rotatable about an axis of rotation "a" that substantially bisects viewing assembly 12 within plane "P." In the present embodiment, support member 18 is preferably a rod formed from a relatively lightweight high strength material such as aluminum. Support member 18 may extend through viewing assembly 12 provided that the thickness of the viewing assembly 12 may be maintained within suitable limits. Alternatively, support member 18 may be divided into portions that extend from viewing assembly 12 along axis "a" in order to minimize interference with the construction of the viewing assembly. If desired, a support base 20 may be included to provide support for support member 18, but it is not necessary.

Support member 18 may be supported on any surface having any orientation including, but not limited to, ceilings, walls, and floors, windows, and the like. For ease of construction, in the present embodiment, support member 18 may be connected to and supported by motor 14. However, it is possible to provide support for viewing assembly 12 by support member 18 on any of the previously described surfaces and connecting motor 14 to support member 18 by other means including, but not limited to, pulleys, and the like. Suitable configurations will be apparent to those of skill in the art.

A brush and collector ring assembly (not illustrated) are also included for conducting power to the illumination source, as is known in the art. Those of skill in the art will understand that any suitable method for providing power may be used. If desired, motor 14 may be provided with a separate speed control (not illustrated) to regulate the rate of rotation and/or a tachometer (not illustrated) to monitor the speed of the motor. Although illustrated herein as a motor, those of skill in the art will recognize that the means for rotation may be any type of device that will impart rotational movement to the viewing assembly. In addition, those of skill in the art will recognize that it is not necessary for the means for rotation to be directly connected to the support member. For example, the means for rotation may be offset to allow belt or gear drive of the viewing assembly.

Those of skill in the art will also recognize that any source of power may be used, such as, for example, batteries, wind, or power from an electrical outlet. In general, typical consumer rated 120 volt AC electrical power may be used, which may be converted to DC with a suitable AC/DC transformer or from suitable DC batteries. Of course, those of skill in the art will recognize that suitable modifications to the assembly will be required, such as, for example, an electrical plug adapted to be received into the electrical outlet. Such modifications are easily accomplished by those of skill in the art.

Figure 1A:
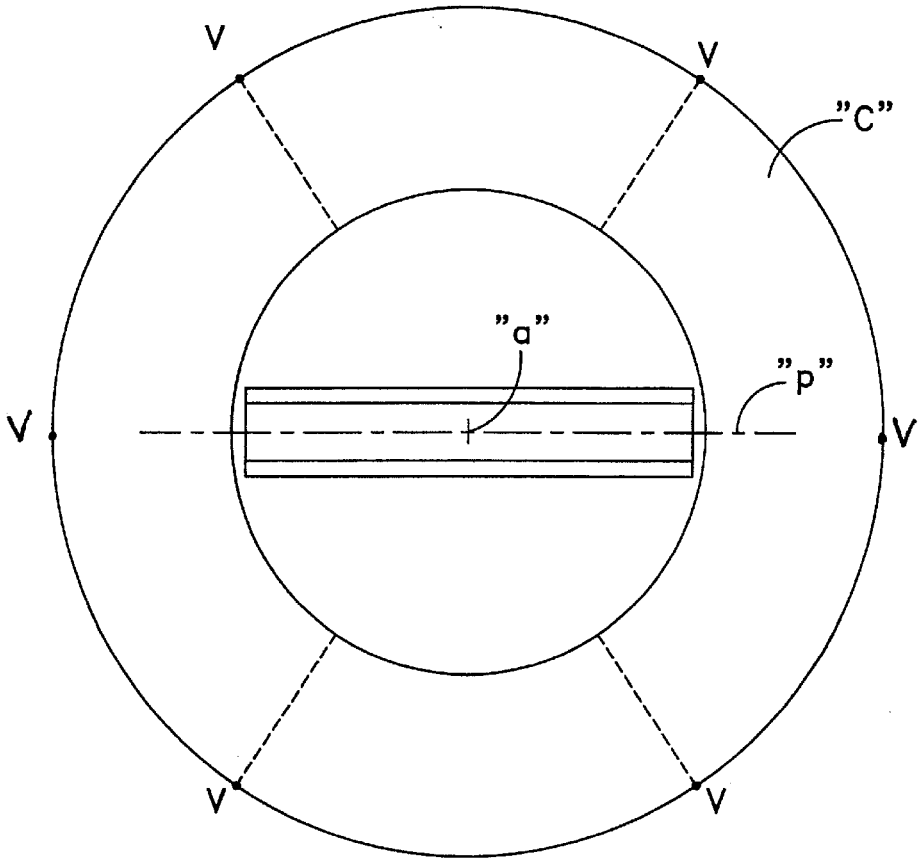
FIG. 1A is a top view of the viewing assembly of FIG. 1 while rotating.

In operation, the system may be placed, for purposes of illustration, on a horizontal surface such as a table. Power may then be turned on, illuminating the viewing assembly and allowing the viewing assembly to rotate at a rate that allows the effect of persistence of vision to occur. FIG. 1A shows a top view of the system during operation. As shown, when rotating, all viewers "V" located circumferentially "C" around viewing system 10 may be able to view the image being displayed on viewing assembly 12. Of course, the distance of each viewer "V" from the viewing assembly may vary depending on each individual's eyesight. Thus, the position of "C" may vary, and its representation is not intended to define a particular distance from the viewing system. Thus it should be apparent that viewers with better eyesight may be able to view the image being displayed from farther away than those with poor eyesight. The important aspect of the method is that is provides a viewer with the ability to view the display at any position surrounding the system, limited only by the viewer's eyesight.

Figure 1B:
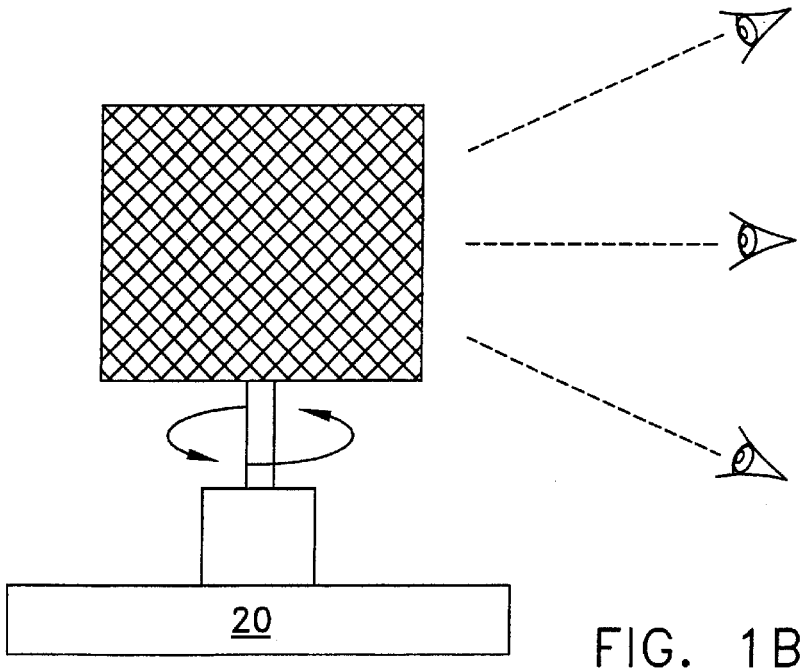
FIG. 1B is a side view of the viewing assembly of FIG. 1 while rotating.

FIG. 1B shows a side view of system 10 during operation. In addition to providing 360 degree viewing, viewers may be able to view the images being displayed on the viewing assembly from a variety of different positions other than orthogonal to the viewing assembly. For example, a viewer standing above or below the viewing system 10 would be able to view the display.

Figure 2A:
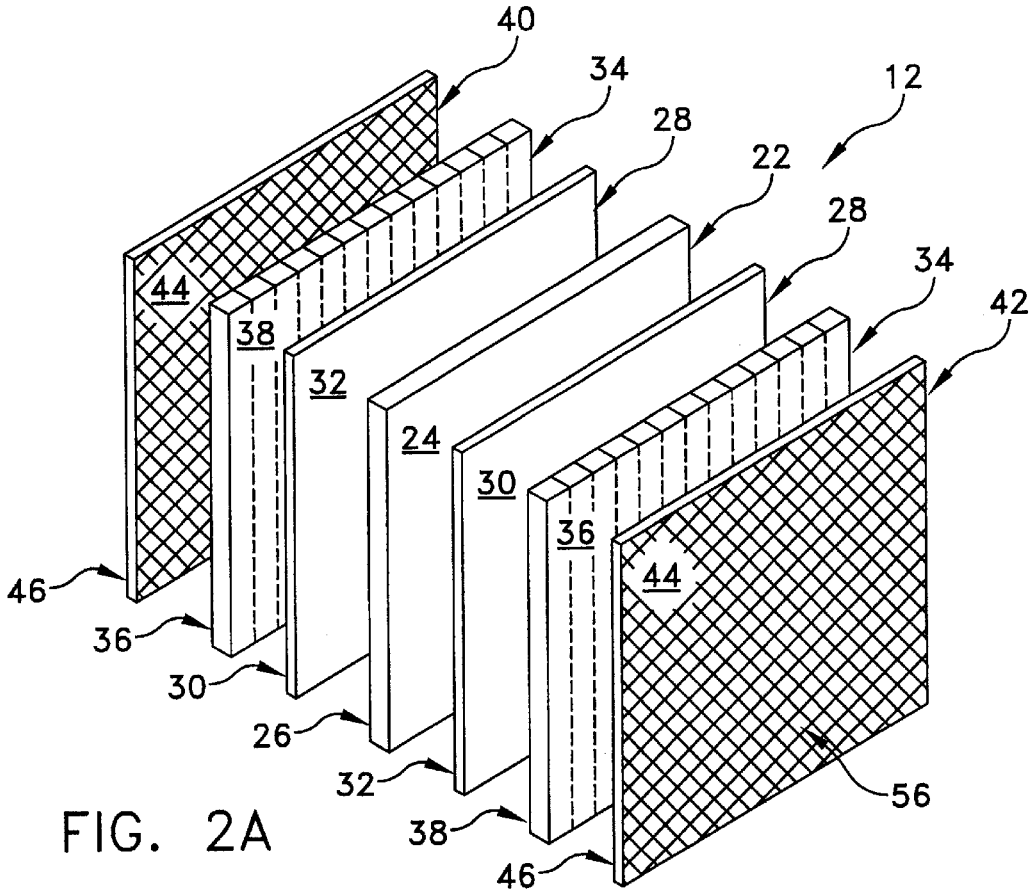
FIG. 2A is an exploded perspective view of the rotatable viewing assembly of FIG. 1.
Figure 2B:
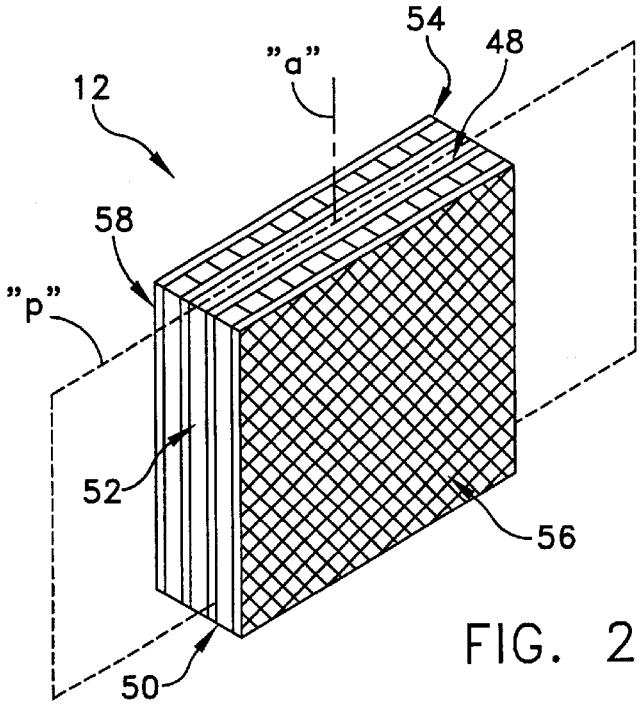
FIG. 2B is an perspective view of the assembled viewing assembly of FIG. 2A.

FIGS. 2A and 2B, when taken together, illustrate the viewing assembly 12 shown in FIG. 1. As shown in exploded view in FIG. 2A, viewing assembly 12 includes a single illumination source 22 having opposing surfaces 24, 26, two image members 28, each having opposing surfaces 30, 32, two blocking members 34, each having opposing surfaces 36, 38, and first and second polarizing filters 40, 42, each having opposing surfaces 44, 46. "Illumination source," as used herein, is meant to define any material that is capable of providing illumination including for example, emitted or reflected light. "Image member," as used herein, is meant to define any material through which light may be transmitted. "Blocking member," as used herein, is meant to define any material or device that selectively blocks, bends, deflects, reflects, or absorbs light.

When assembled as shown in FIG. 2B, viewing assembly 12 includes opposing upper and lower edges 48, 50, opposing side edges 52, 54, and opposing outer surfaces 56, 58. In the present embodiment, each surface 24, 26 of illumination source 22 is a light emitting surface. In the present embodiment, opposing surface 24 of illumination source 22 is positioned in adjacent relation to a surface 32 of image member 28; surfaces 30 of image members 28 are positioned in adjacent relation to surfaces 38 of blocking members 34;

one of blocking members 34 has a surface 36 positioned in adjacent relation to surface 44 of polarizing filter 40 having a first orientation; and the remaining blocking member 34 has a surface 36 positioned in adjacent relation to surface 46 of polarizing filter 42 having a second orientation perpendicular to the first polarizing member 40. In the present embodiment, the adjacent surfaces of illumination source 22, image members 28, blocking members 34, and polarizing filters 40, 42 are also preferably positioned in direct contact with one another.

Viewing assembly 12 may be assembled by any method known to those of skill in the art, for example, by glueing, taping, clasping, clipping, or clamping the edges of the illumination source, image member, blocking member, and polarizing filter, together. This may be accomplished by, for example, adhesion, provided that the adhesion method does not interfere with light transmission.

Suitable materials from which image members may be formed include photographic transparencies, LCD panel, a layer of ink, printed text on clear acetate, orthographic film, and the like. An image may be formed on or in each image member, which may be the same or different.

In some embodiments, the illumination source and image member may be integral, which will be referred to hereinafter as an illumination/image member. Thus, "illumination/image member," as used herein, is meant to define any material that is capable of providing both illumination and an image without the assistance of an image member.

Examples of suitable planar illumination sources include electroluminescent panels (ELPs), fluorescent displays, organic light emitting devices (OLEDs), light conductive elements such as light pipes, woven fiber optic panels, vertical or horizontal arrangements of cold cathode florescent tubes, edge-lit light guides, and the like. Examples of illumination sources that may be made into a planar configuration include light pipes, woven fiber optic elements, conductive light elements, and the like. An image may be formed on or in the image member. Edge-lit light guides are one preferred illumination source (available from Bright View Technologies, formerly CLIO Technologies Inc., Holland, Ohio under the product name CCFL, edge light-light guide).

Examples of other suitable illumination/image sources include organic light emitting devices (OLEDs), transparent organic light emitting devices (TOLEDs), stacked organic light emitting devices (SOLEDs), flexible organic light emitting devices (FOLEDs), woven fiber optic panels, etchings or carvings directly in the illumination member, and the like.

Examples of suitable blocking members include a shutter, a louver, a grating, a screen, a lenticular sheet, a prism, a lens, a Light Control Film (available under the product name Light Control Film from 3M), or any suitable material or device that would be apparent to those of skill in the art. In preferred embodiments, the blocking members may be adjustable. The selection of material for the blocking member will depend on the application as well as practical considerations. The blocking member may have any shape or size.

In a particularly preferred embodiment, the blocking member may be a Light Control Film (LCF) (available from 3M, St. Paul, Minn.). Such films simulate a tiny venetian blind or louver and shield unwanted ambient light, direct the display of light, or both. The effect of the films is similar to venetian blinds whereby narrow strips of light blocking material allow a limited field of view. This field of view may be regulated by the width of the louvers, the distance between the louvers, and the number of louver contained within the given area. Such films may be available with a variety of viewing angles (i.e. louver angles). The selection of the viewing angle, or louver angle, will depend on the application as well as practical considerations. For example, where "sharper" images are desired, it is generally desirable to provide a narrower viewing angle. Generally, LCFs with narrower louver angles will provide narrower viewing angles and consequently sharper images. For example, an LCF with a 24 degree louver angle will provide a sharper image than a 48 degree louver. In another particularly preferred embodiment, the blocking member may be a "skived film" (available from 3M, St. Paul, Minn.), which is an unlaminated version of an LCF.

As shown in the present embodiment, the viewing assembly may include polarizing filters arranged to polarize light in opposite directions, which may be used in conjunction with polarized glasses, as discussed in greater detail below. Those of skill in the art will recognize that the polarizing filters may be used in any of the embodiments described below. Moreover, although illustrated herein with the polarizing filter overlaying the blocking members, those of skill in the art will recognize that the position of the filters is not crucial to the invention. For example, a polarizing filter may be disposed between the illumination source and the image member or it may overlay a blocking member.

It is generally advantageous to minimize the distance between the image member and the axis of rotation "a." As the distance between the image member and the axis of rotation "a" (and consequently plane "P") increases, the clarity of the image provided will decrease and image distortion will increase. Conversely, minimizing the distance between the image member and axis "a" generally minimizes image distortion and increases clarity when the viewing assembly is rotating.

One way of minimizing the distance between the image member and the axis of rotation is to minimize the thickness of the viewing assembly. For example, when the surface of the image member remains very close to axis "a," the perceived rotational motion at eye level is virtually nonexistent. In contrast, using a rotating viewing assembly at low speed without the louvers attached would provide an image that would appear to repeatedly "grow" from a vertical line until it reached its full size and then "contract" upon itself. In some instances, the particular arrangements may be limited by the thickness of each. For example, it is possible to provide a blocking member "sandwiched" between an illumination source and an image member, provided the blocking member is relatively thin, as are the LCFs or skived films.

The arrangement of the illumination source, image member and blocking member may be non-planar or substantially planar, each of which provide specific optical effects, as described in greater detail below. In embodiments in which the viewing assemblies are substantially planar, it is preferred that a substantial portion of the viewing assembly lies within or is coplanar with plane "P" which is parallel to axis "a." By "substantially planar," it is meant that the viewing assembly has less than about 20 percent surface deviation and may be slightly convex or concave, and have other minor surface variations.

Figure 2C:
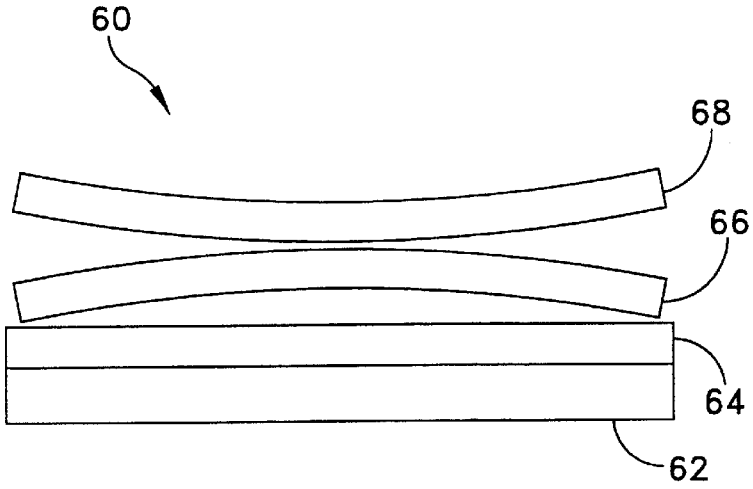
FIG. 2C is a top plan view of another embodiment of a viewing assembly having a non-planar configuration.
Figure 2D:
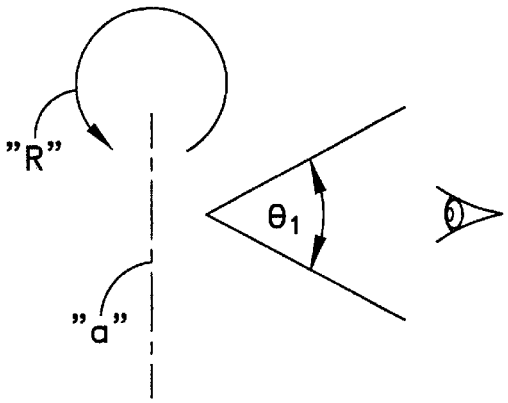
FIG. 2D is an illustration showing the field of view obtained utilizing a single blocking member.
Figure 2E:
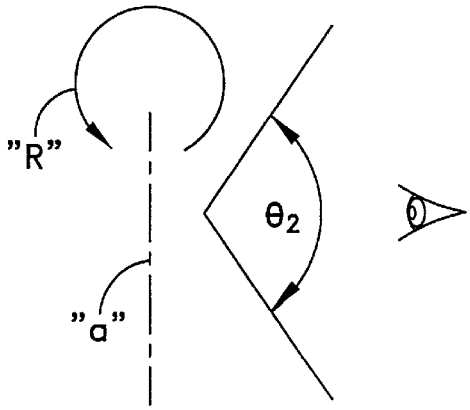
FIG. 2E is an illustration showing the field of view obtained utilizing two blocking members arranged as shown in FIG. 2C.

Although illustrated in the present embodiment as substantially planar, the viewing assemblies may have any shape or size, depending on the desired optical effect. One example of such a viewing assembly 60 is shown in top view in FIG. 2C. Viewing assembly 60 includes an illumination source 62, an image member 64, and two blocking members 66, 68 which are, in the present embodiment, microlouvers having a field of view of about 48 degrees. Preferably, the illumination source 62 and image member 64 are positioned in adjacent relation. Blocking members 66, 68 both have curved profiles. The outer edges of blocking member 66 are positioned adjacent image member 64 such that the backside of blocking member 66 faces outwardly. The backside of blocking member 68 is positioned adjacent the backside of blocking member 66 such that the outer edges of blocking member 66 face outwardly. Arranging blocking members 66, 68 in this manner reduces the field of view of the microlouvers from about 48 degrees to an effective field of view of about 15 degrees. The resulting optical effect is one in which the vertical range of view is increased from $\theta_1$ to $\theta_2$ for a viewer, as shown comparatively in FIGS. 2D and 2E.

Figure 3A:
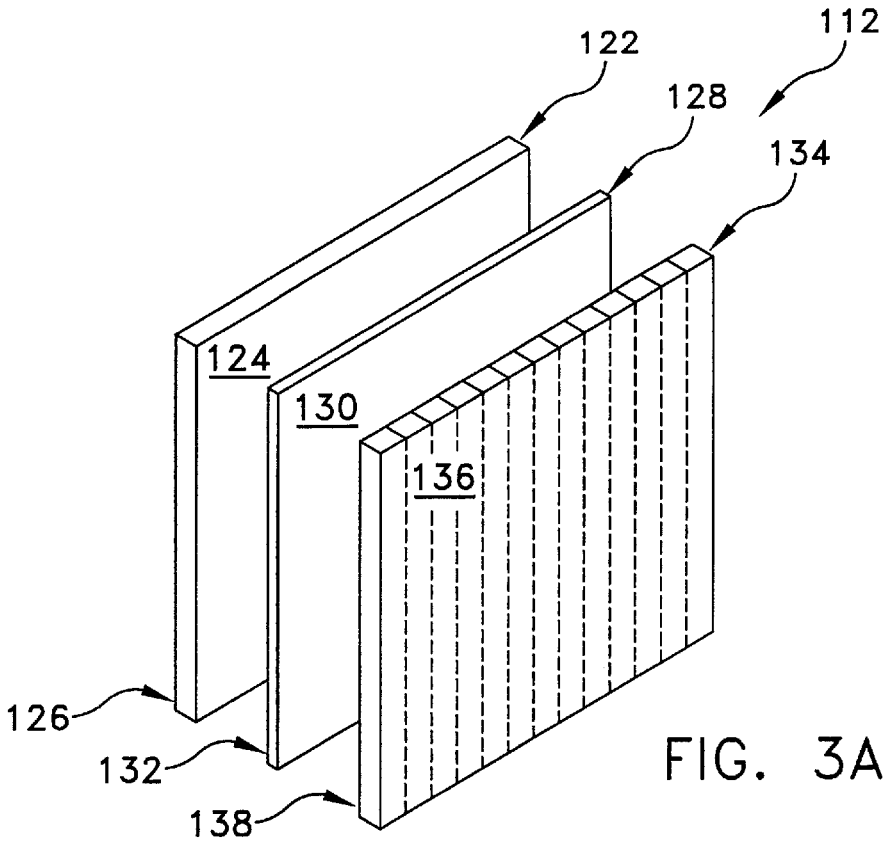
FIG. 3A is an exploded perspective view of another embodiment of a viewing assembly.
Figure 3B:
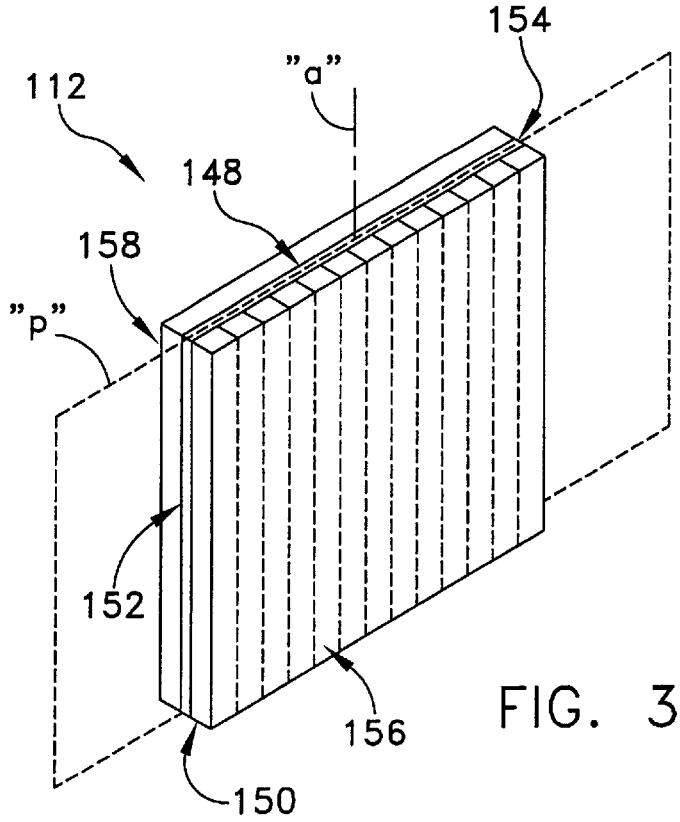
FIG. 3B is an perspective view of the assembled viewing assembly of FIG. 3A.

As stated above, a variety of viewing assemblies may be used in the foregoing system as well as any other of the systems described herein. Another embodiment of a viewing assembly 112 is illustrated in FIGS. 3A and 3B taken together. As shown in exploded view in FIG. 3A, viewing assembly 112 includes an illumination source 122 having opposing surfaces 124, 126, an image member 128 having opposing surfaces 130, 132, and a blocking member 134 having opposing surfaces 136, 138.

When assembled as shown in FIG. 3B, viewing assembly 112 includes opposing upper and lower edges 148, 150, opposing side edges 152, 154, and opposing surfaces 156, 158. In the present embodiment, surface 124 of illumination source 112 is a light emitting surface. In the present embodiment, the illumination sources, image members, and blocking members may be the same as those previously discussed, and the viewing assembly may be constructed in a similar manner as the previous embodiments.

Figure 3C:
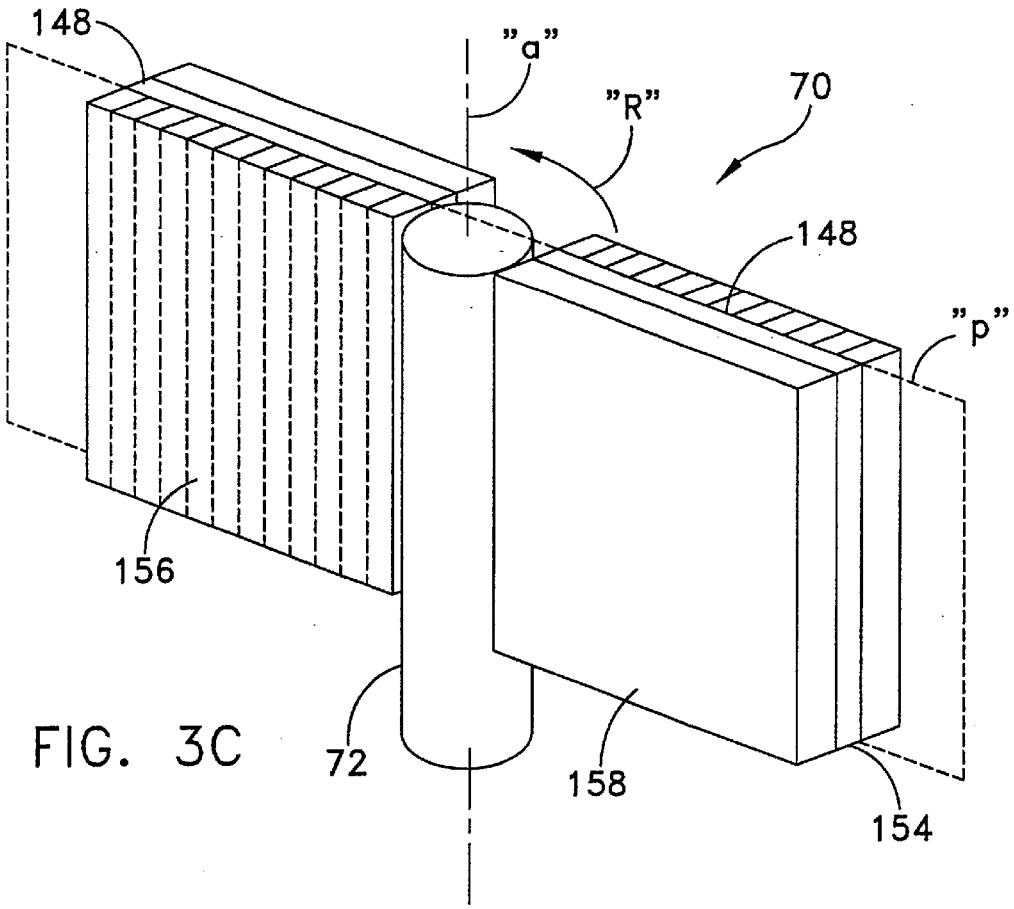
FIG. 3C is a perspective view of another embodiment of a viewing assembly.
Figure 3D:
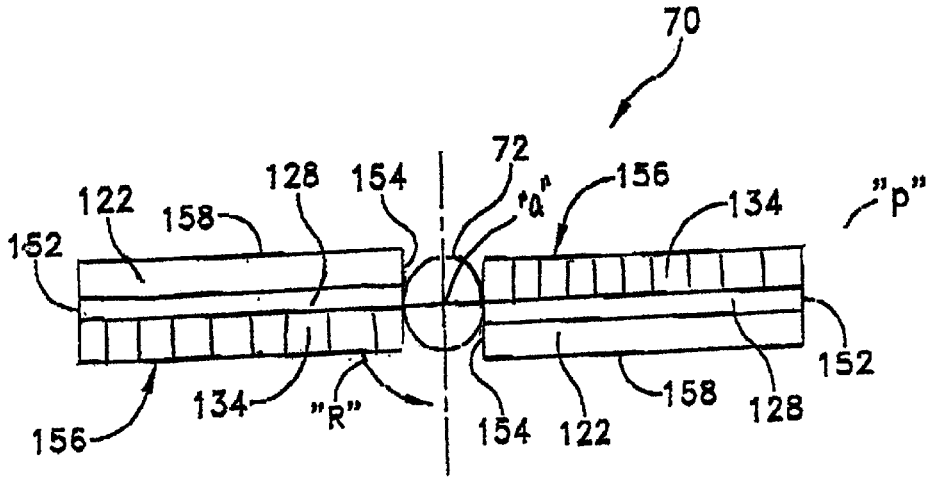
FIG. 3D is a top plan view of the viewing assembly of FIG. 3C.

As stated above, it is generally advantageous to minimize the distance between the image member and the axis of rotation "a." Another way of minimizing the distance between the image member and the axis of rotation is to mount the image member such that it is coplanar with plane "P" or substantially coplanar with plane "P." FIGS. 3C and 3D show perspective and top views of a viewing assembly 70 utilizing such an arrangement. Viewing assembly 70 includes two viewing assemblies 112 as illustrated previously in FIGS. 3A and 3B, mounted for rotation on supporting rod 72. As shown, surface 156 of viewing assembly 70 is coplanar with plane "P." To accommodate such an arrangement, the remainder of the viewing assembly (i.e., the image member 128 and illumination source 122) must be mounted behind or in front of plane "P." In the present embodiment, the illumination sources, image members, and blocking members may be the same as those previously discussed, and the viewing assembly may be constructed in a similar manner as the previous embodiments.

As shown in FIGS. 3C and 3D, in the present embodiment, both the image member 128 and illumination source 122 extend behind plane P and travel behind surface 156 when the viewing assembly is rotating in the direction indicated by arrow "R." Such an arrangement may be advantageous when it is desirable to have brighter illumination sources, which are generally relatively thicker than less bright illumination sources. Arrangements using thicker light sources typically mean that the distance between the face of the viewing assembly and the axis of rotation is increased, resulting in less clarity and increased image distortion. Thus, an arrangement using thicker illumination sources in which the face of the viewing assembly is coplanar with plane P may be desirable, for example, in ambient light conditions, and in some instances brighter than ambient conditions.

Figure 4A:
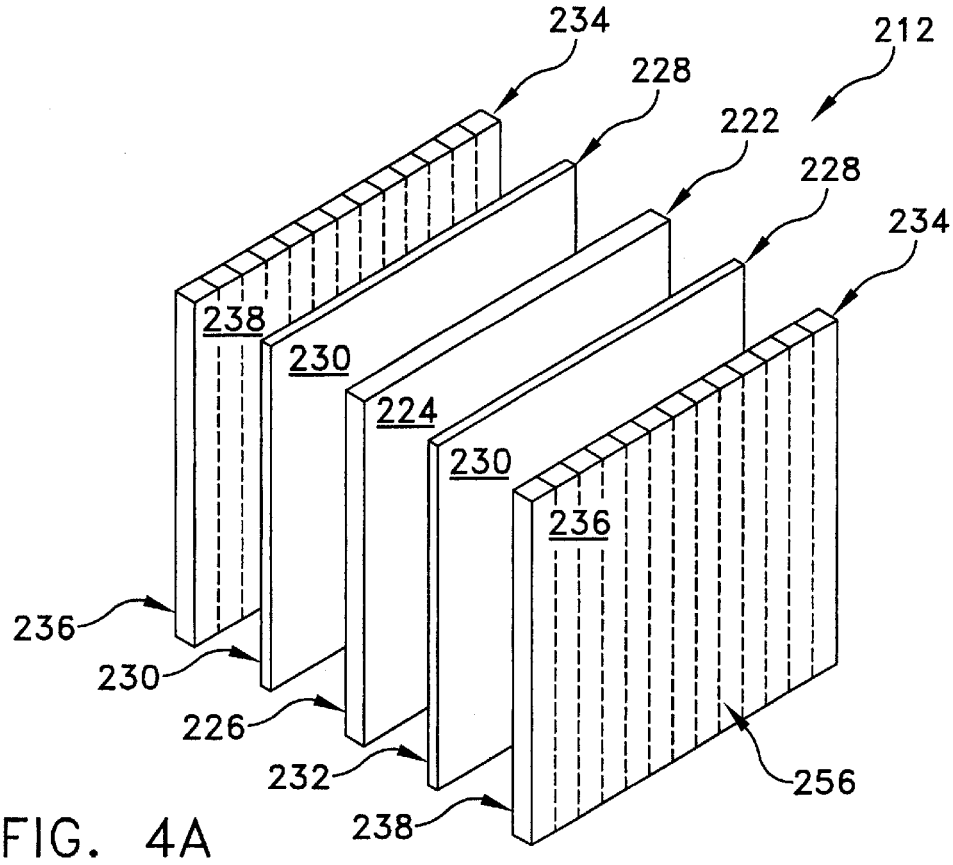
FIG. 4A is an exploded perspective view of another embodiment of a viewing assembly.
Figure 4B:
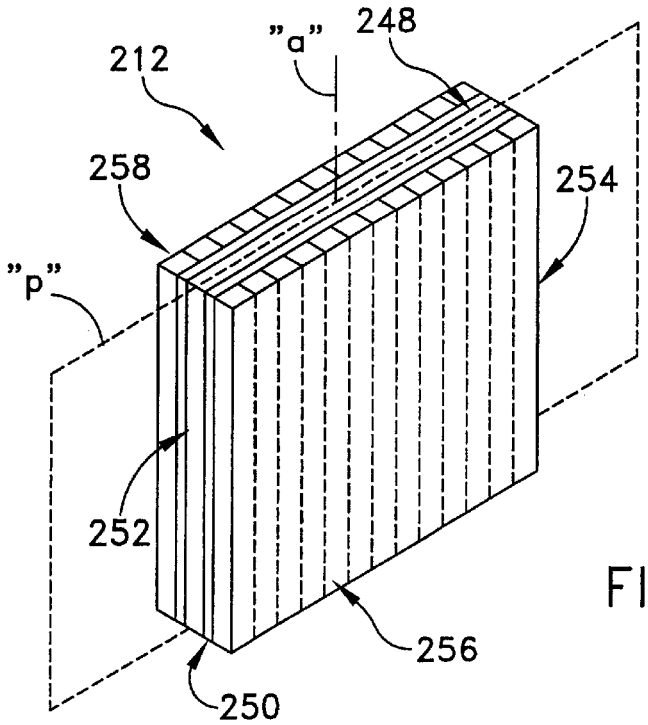
FIG. 4B is an perspective view of the assembled viewing assembly of FIG. 4A.

Another embodiment of a viewing assembly 212 is illustrated in FIGS. 4A and 4B. As shown in exploded view in FIG. 4A, viewing assembly 212 includes an illumination source 222 having opposing surfaces 224, 226, two image members 228, each having opposing surfaces 230, 232, and two blocking members 234, each having opposing surfaces 236, 238. In the present embodiment, illumination source 222 may emit light from one or both of the opposing surfaces 224, 226. Thus, when provided with a suitable source of power to illuminate the illumination source 222, viewing assembly 212 may emit light from one or both surfaces.

When assembled as shown in FIG. 4B, viewing assembly 212 includes opposing upper and lower edges 248, 250, opposing side edges 252, 254, and opposing surfaces 256, 258. In the present embodiment, the illumination sources, image members, and blocking members may be the same as those previously discussed. The present viewing assembly is constructed in a similar manner as the previous embodiments with the exception of the polarizing filter. Although illustrated herein with two illumination sources, those of skill in the art will recognize that only one may be used if desired. When a single illumination source that emits light from both opposing surfaces is used, and polarized filters are included, the arrangement of the polarized filters is as described above.

Figure 5A:
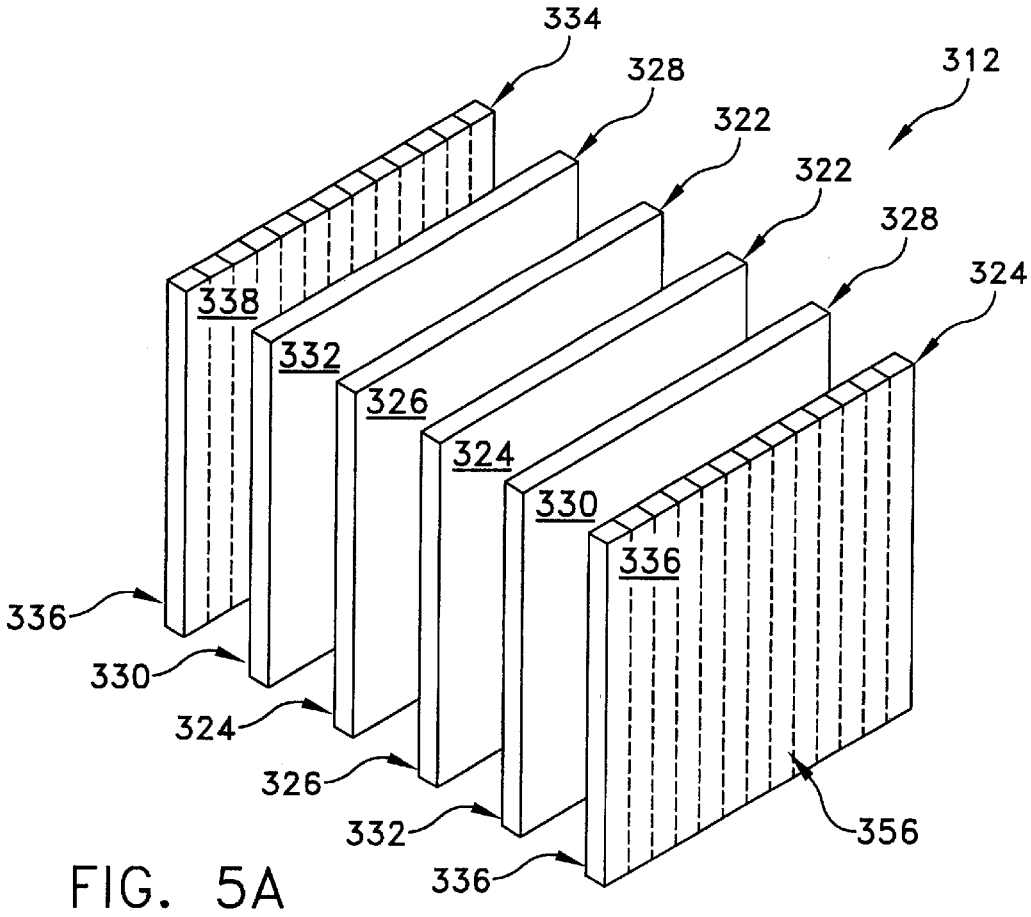
FIG. 5A is an exploded perspective view of another embodiment of a viewing assembly.
Figure 5B:
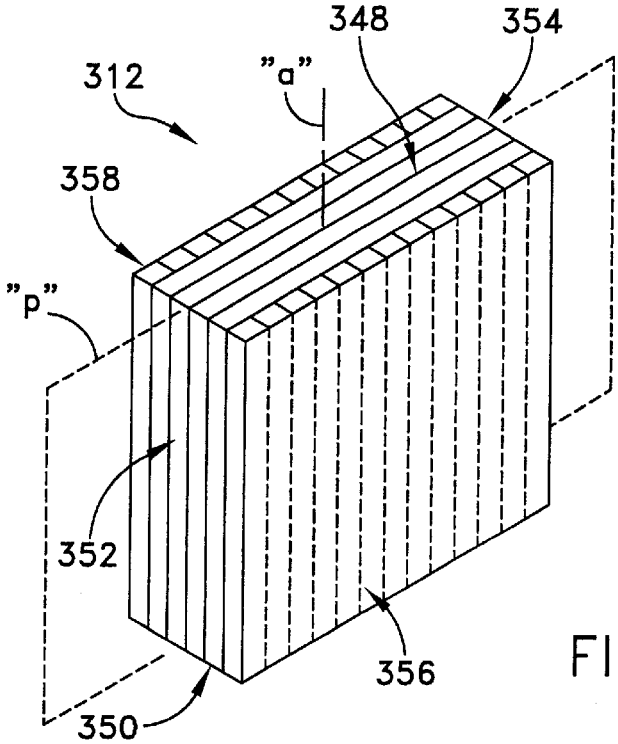
FIG. 5B is an perspective view of the assembled viewing assembly of FIG. 5A.

Another embodiment of a viewing assembly 312 that includes two illumination sources will be illustrated with references to FIGS. 5A and 5B taken together. In some instances, such as when using an illumination source that provides light through only one surface, or when it is desired to maximize the amount of light transmission from opposing sides of the viewing assembly, it may be desirable to include additional illumination sources in the viewing assembly. Thus, viewing assembly 312 differs from the previous viewing assemblies by the inclusion of an additional illumination source. As shown is exploded view in FIG. 5A, viewing assembly 312 includes two illumination sources 322, two image members 328, and two blocking members 334. In the present embodiment, each illumination source 322 may include a light emitting surface and a non-light emitting surface, and the illumination sources may be arranged such that the non-light emitting surfaces face each other and the light emitting surfaces face outwardly.

When assembled as shown in FIG. 5B, viewing assembly 312 includes opposing upper and lower edges 348, 350, opposing side edges 352, 354 and opposing surfaces 356, 358. In the present embodiment, the illumination sources, image members, and blocking members may be the same as those previously discussed and the viewing assembly may be constructed in a similar manner as the previous embodiments.

As stated above, in some embodiments of the viewing assembly, a unitary illumination/image source may be provided rather than separate illumination sources and image members, which may sometimes simplify the construction of the viewing assembly. In such instances, the illumination/image source acts both as a source of illumination and a source of an image. Examples of these include OLEDs, FOLEDs, and etchings or carvings directly into the illumination member.

Figure 6:
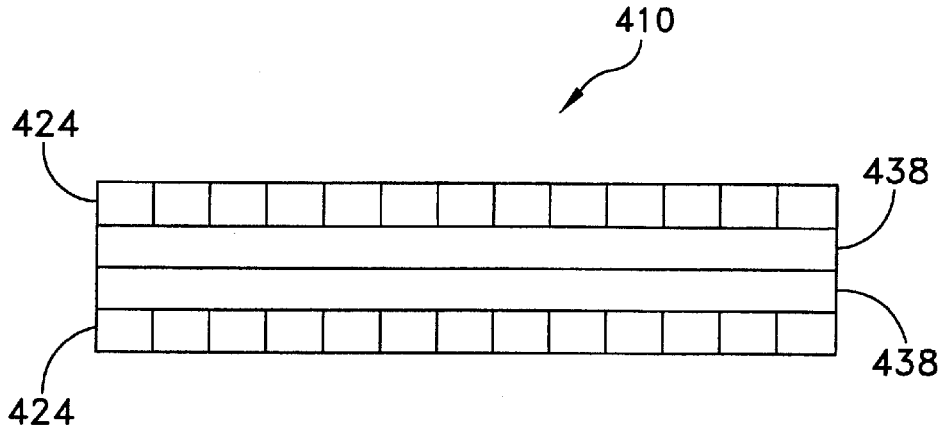
FIG. 6 is a top view of another embodiment of a viewing assembly that includes an illumination/image source.

FIG. 6 is a top view of a viewing assembly 410 that includes two illumination/image sources 434. Viewing assembly 410 differs from the previous viewing assemblies by the elimination of separate image members. The assembly of the present viewing assembly is the same as in previous embodiments. Thus, in the present embodiment, one opposing surface (not illustrated) of each illumination/image source 438 may be positioned in adjacent relation to one of the opposing surfaces (not illustrated) of blocking members 424. In the present embodiment, the illumination/image member and blocking members may be selected from those previously described and the viewing assembly may be constructed in a similar manner as the previous embodiments.

Figure 7:
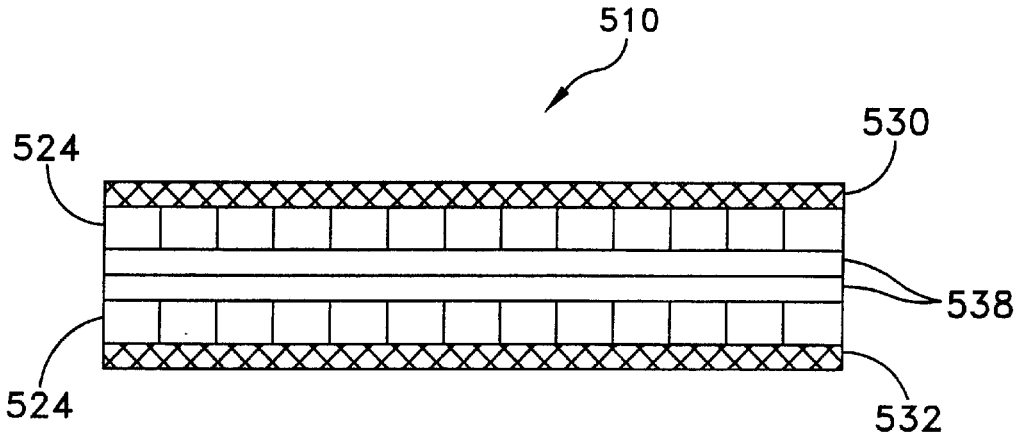
FIG. 7 is a top view of another embodiment of a viewing assembly that includes an illumination/image source and polarizing filters.
Figure 8:
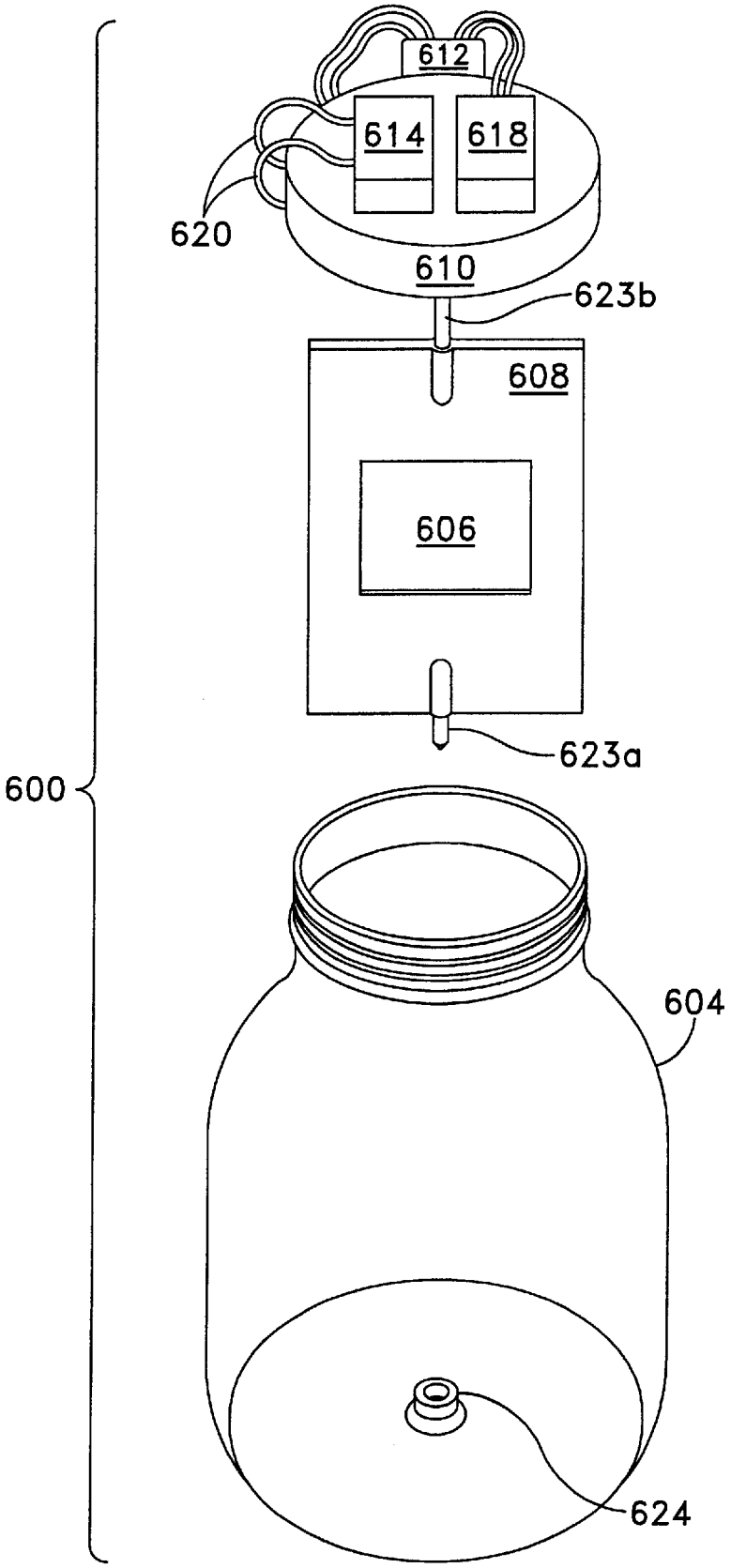
FIG. 8 is a perspective exploded view of another embodiment of a viewing system that includes a rotatable viewing assembly.
Figure 9:
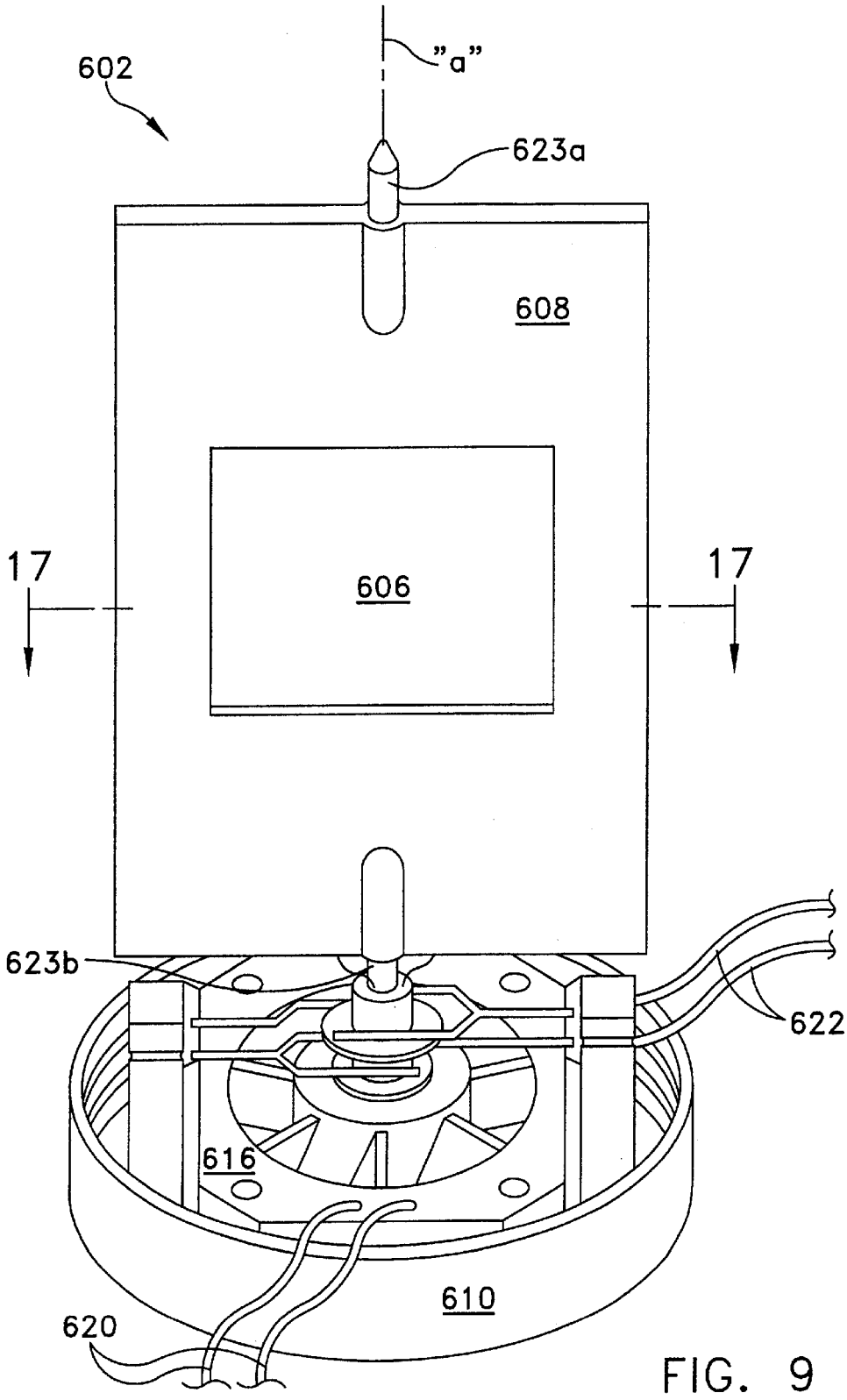
FIG. 9 is a perspective view of the viewing assembly of the system of FIG. 10.

FIG. 7 is a top view of a viewing assembly 510 that includes two illumination/image sources 538, two blocking members 524, and first and second polarizing filters 530, 532. The viewing assembly of the present embodiment differs from the previous embodiment by the inclusion of the polarizing filters. In the present embodiment, one opposing surface (not illustrated) of each illumination/image source 538 may be positioned in adjacent relation to one of the opposing surfaces (not illustrated) of blocking members 524. Preferably, one of the polarizing filters 530, 532 may be positioned adjacent to each blocking member 524. Thus, in the present embodiment, first polarizing filter 530 having a first orientation may overlay each blocking member 524, and a second polarizing filter 532 having a second orientation perpendicular to the first polarizing filter 530 may overlay the remaining blocking member 524. In the present embodiment, the illumination/image member and blocking members may be selected from those previously described and the viewing assembly may be constructed in a similar manner as the previous embodiments.

Another embodiment is directed to a method that involves rotating the illuminated viewing assembly. When the viewing assembly is rotated and power supplied to the illumination source or illumination image/member, light may be emitted from the illumination source, transmitted through the image members, when included, and through the apertures in the blocking members. In this manner, the light emitted may reach a viewer viewing the viewing system at any position orthogonal to, and from a plurality of positions oblique to, the axis "a" about which the viewing system may be rotating. Any viewer at any of the above-described positions relative to the viewing system may simultaneously observe the same image. As the viewing assembly rotates, the louvers prevent the viewer from seeing the illuminated image member until the plane of the viewing assembly has rotated to 0 degrees (+ or −24 degrees) of the viewers' line of sight. The effect is such that as the viewing assembly rotates at a given rate, the images on the image members on one or both sides of the viewing assembly are presented consecutively without the motion blur that would otherwise be inherent in a rotating screen. This effect is due to the alignment of the images on either side of the screen together with effect of persistence of vision.

As stated previously, the rotation rate of the viewing assembly may vary, depending upon the desired effect as well as practical considerations. Various effects may be achieved with the different viewing assemblies, each of which may be rotated about axis "a" at different rates.

One embodiment of the method involves a viewing assembly that includes two different images, which may be rotated about axis "a" to provide the perception of motion. In the present embodiment, due to the persistence of vision, the mind perceives the changing images as actual motion, or animated imaging. Preferably, in the present embodiment, the viewing assembly may be rotated about axis "a" at a rotation rate of about 120 RPM to about 600 RPM, more preferably about 160 RPM to about 525 RPM, and more preferably still about 200 RPM to about 450 RPM. At this rate of rotation the image member is also able to display printed text, graphics, or any combination thereof.

At relatively higher rotation rates, the stroboscopic effect is eliminated, but the ability to present animation is lost. However, the viewing assembly can still contain printed text, graphics, photographs, or any combination thereof. Thus, another embodiment of the method involves a viewing assembly that includes the same or different images, which may be rotated about axis "a" to provide a uniform image (see Example 2 below). In the present embodiment, a range of rotational speeds may be used such that stroboscopic effects that would otherwise occur at lower rotational rates are eliminated or made imperceptible, resulting in a uniform image. The stroboscopic effects are eliminated or made imperceptible by increasing the rotation rate of the viewing assembly. Thus, in the present embodiment, the viewing assembly preferably may be rotated about axis "a" at a rotation rate of at least about 1200 RPM, more preferably at least about 1400 RPM, and more preferably still at least about 1750 RPM.

For example, the viewing assembly could include one image member containing printed text and another image member including a picture. When rotated at the desired rate, a viewer may perceive the printed text overlaying the picture. Alternatively, the printed text may be disposed on the upper half of the first image member and the picture on the lower half of the second member such that when rotated, the viewer perceives a single image in which the text is disposed above the picture.

It should be noted that the rotation rates of any of the previously described embodiments do not necessarily need to remain a constant, and that it may be desirable to change rotation rates as part of the presentation, especially if multiple illuminated panels and text are mounted to the same viewing assembly.

In yet another embodiment, the viewing assembly may include a screens of the type used in computer and video displays. For example, an LCD may be used as an image member, with an illumination source behind the LCS screen. The rotational rates of the viewing assembly in the present embodiment preferably correspond to the scan rates of the screens. For example, LCD video screens generally scan at a rate of 29.97 scans per second. In other instances, it is not necessary that the correspondence be exact. For example, a similar effect may be achieved with a rotational rate that is +/−10% of the scan rate. Those of skill in the art will recognize that scan rates vary depending on the type and manufacturer of the screens. In addition, some screens are manufactured to include adjustable scan rates.

According to any of the methods described above, a viewing assembly that is illuminated on only one side may be used. However, in order to achieve any of the described effects with such a viewing assembly, the rotation rate of the assembly must be about double what is required for a viewing assembly that is illuminated on two sides. Moreover, viewing assemblies that are illuminated on only one side may not be capable of providing an animation effect.

Figure 18:
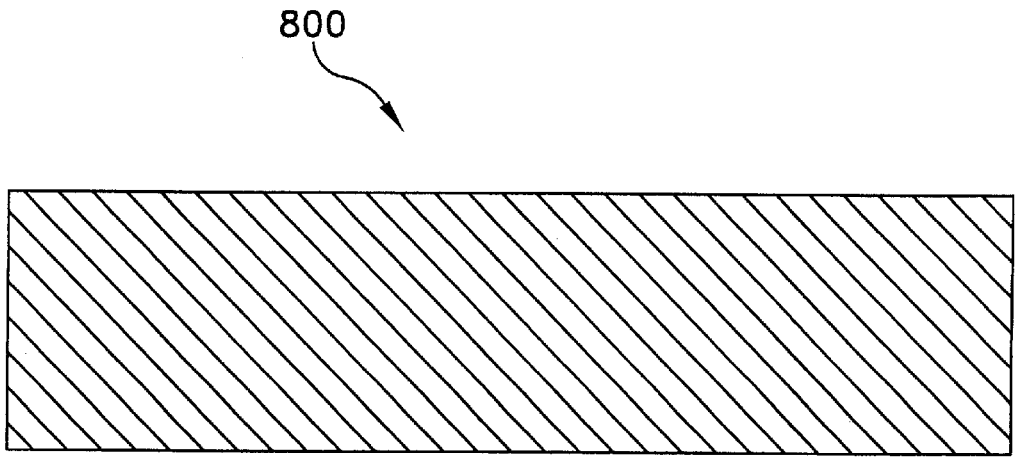
FIG. 18 is a schematic illustration of a sheet of polarized film with the angle of polarization at a 45 degree angle to horizontal.
Figure 19:
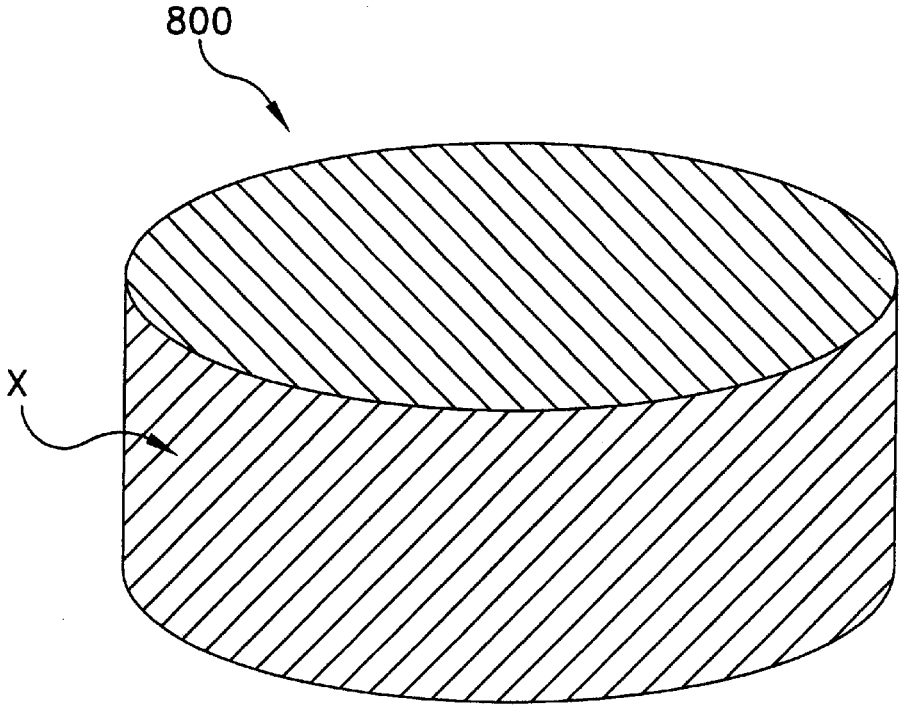
FIG. 19 illustrates the sheet of FIG. 18 arranged in a cylindrical shape.

In some instances, it may be desirable or necessary to block from view structures on the opposite side of the viewing system in order to minimize visual interference for the viewer. This may be accomplished, for example, by positioning a polarizing film 800 as shown in FIG. 18 such that it would surround a viewing assembly or system as shown in FIG. 19, when the angle of the polarizing film 800 is at about 45 degrees to horizontal. In this manner, the orientation of the polarizing film 800 at any two opposing points on the film will be perpendicular. This may be accomplished most easily when the viewing system is surrounded by a housing. For example, because the viewing assembly is rotating continuously it may be necessary to shield it from unwanted obstacles such as hands or other means of obstruction and to minimize wind resistance to the surface of the rotating assembly. This may be achieved by enclosing the viewing assembly within a housing constructed from transparent material such as glass or acrylic. Preferably, the housing may be preferably mounted coaxially around axis "a" of a viewing assembly such that the viewing assembly can rotate freely inside. At high rates of rotation it may be desirable to create an air vacuum within the housing to eliminate wind resistance.

To improve the contrast and overall visibility of the viewing assembly it may be necessary to provide a dark background that blocks the view of structures and lights on the opposite side of the viewing system. As shown in FIG. 19, at point "X" the angles of polarization are perpendicular and light is effectively blocked. When an object or illuminated form is placed within the cylinder it appears before a black background that effectively follows the viewer within a 360-degree circumference of the cylinder. This may be accomplished by positioning a layer of polarizing film completely around the viewing system such that the angle of polarization is at 45 degrees to horizontal. In this manner, on any two opposing points on the film the polarization will be perpendicular, therefore blocking unwanted light. When this polarizing film lines the interior or exterior of the transparent housing the effect is that of a constant black background behind the rotating viewing assembly.

When the viewing assembly is contained within a cylindrically shaped transparent housing lined with polarizing material, the viewing assembly has the unique ability to present two-phase animated images, flicker-free images and video or computer generated images in 360-degrees. When positioned in the center of a room, this imagery is visible to any number of viewers simultaneously within a 360-degree perimeter of the display.

In addition, stereo-optic displays may be provided to viewers with the assistance of polarizing glasses, which facilitate a method of providing depth-perception to a viewer or viewers when viewing a rotating viewing assembly. The stereo-optic effect may only be observed when polarizing filters are included in the viewing assembly. The stereo-optic effect is negated when the glasses are used in conjunction with a polarizing film surround. The stereo-optic images may be viewed from any position orthogonal to, and from a plurality of positions oblique to, the axis on which the viewing assembly may be rotated. Thus, several viewers positioned at various positions around a viewing system may be able to view the display provided by the viewing system as a stereo-optic display.

The present invention will be further illustrated by the following examples, which are intended to be illustrative in nature and are not to be considered as limiting the scope of the invention.

WORKING EXAMPLES

Systems incorporating different viewing assemblies were constructed to demonstrating of the advantages of the present viewing assemblies and systems.

Example 1

One example of an exemplary viewing system 600 will be illustrated with reference to FIGS. 8–13, when taken together. The viewing system 600 included a transparent housing 604 and a viewing assembly 606 of the type illustrated in FIGS. 2A,B. The viewing assembly 606 was disposed within a frame of black plastic material 608 having a total thickness of about ⅛ inch. The viewing assembly was secured within the frame using black double-sided adhesive tape.

A support 610 was used to provide support for an inverter 612, two batteries 614, 618, and a motor 616 which in the present embodiment was a fan (available from Radio Shack). Inverter 612 was coupled to battery 618, which was a 9 V DC battery. Battery 618 was in turn coupled to the ELPs via brushes and collector rings (not illustrated) mounted on rod portion 623*b* and via lead wires 622. Battery 614 was a 4.5 V DC battery coupled to the motor 616 via lead wires 620. Thus, battery 614 supplied power to rotate the motor 616 and battery 618 supplied power to illuminate the ELPs.

Support rod portions 623*a,b* were connected to frame 608 along axis "a," which substantially bisects the viewing assembly 606. Support rod portion 623*b* was connected directly to the motor 616. Support rod portion 623*a* was inserted into a boss member 624 in housing 604.

Viewing assembly 606 included two ELPs as the illumination source (available as product No. H90002W Proto-Kut Lamp from BKL Inc.). Each of the ELPs included a light emitting surface and a non-light emitting surface. The non-light-emitting surfaces of the ELPs were disposed adjacently and in direct contract with one another to form a substantially planar unit with the light emitting surfaces facing outwardly.

Figure 11:
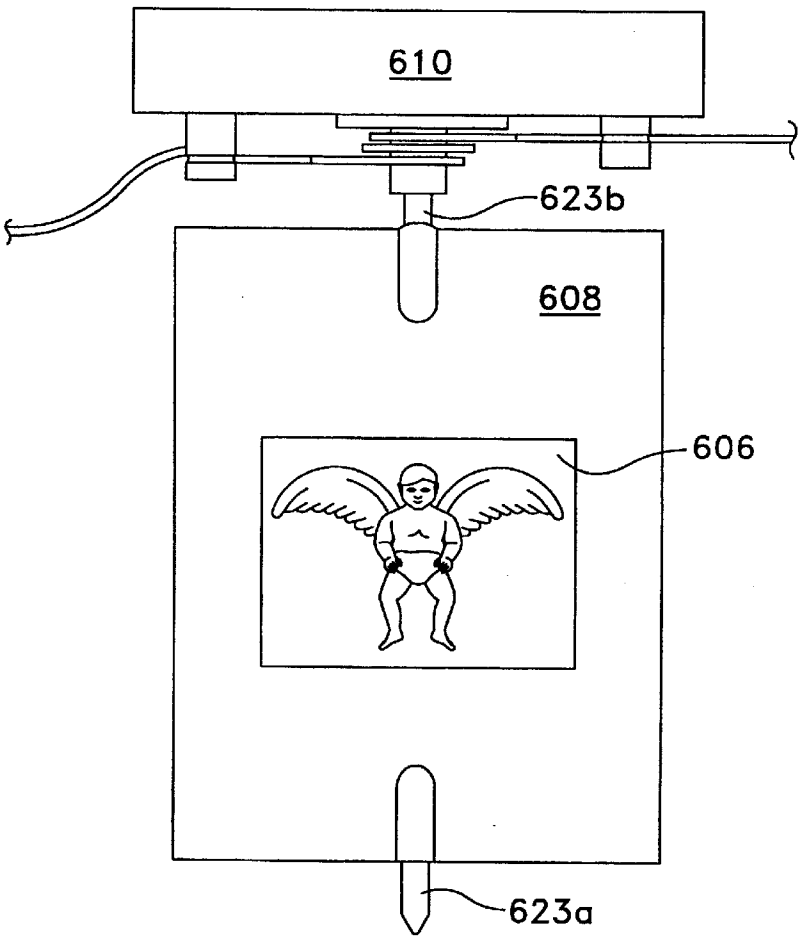
FIG. 11 is a side view of the viewing assembly of FIG. 8 showing the second image member.
Figure 10:
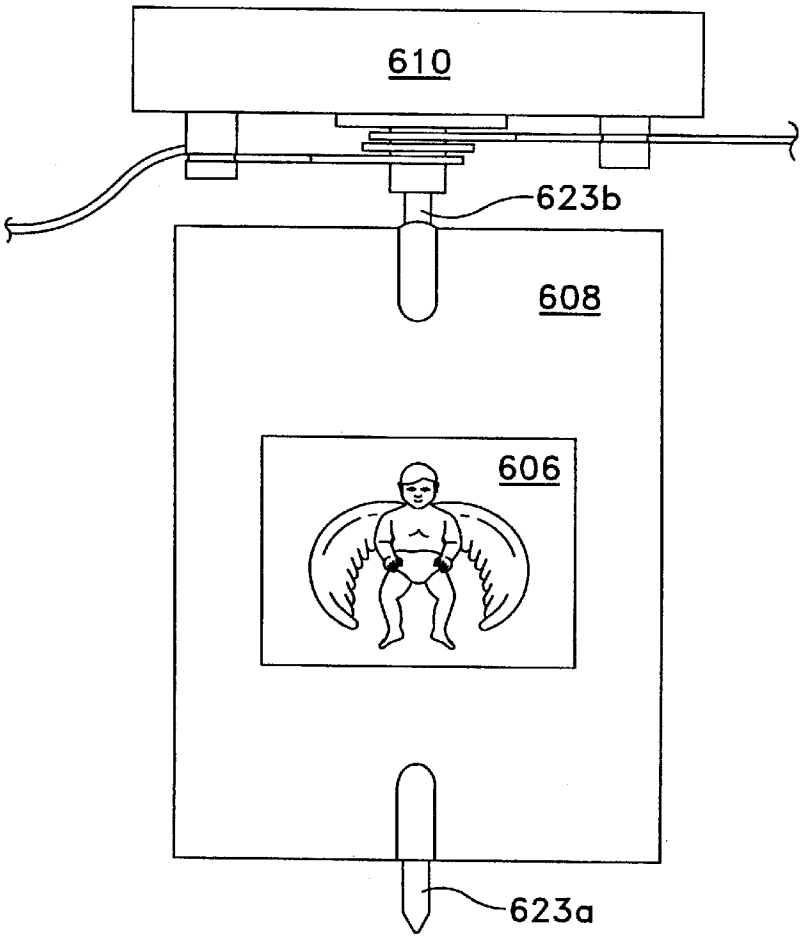
FIG. 10 is a side view of the viewing assembly of FIG. 8 showing the first image member.
Figure 12:
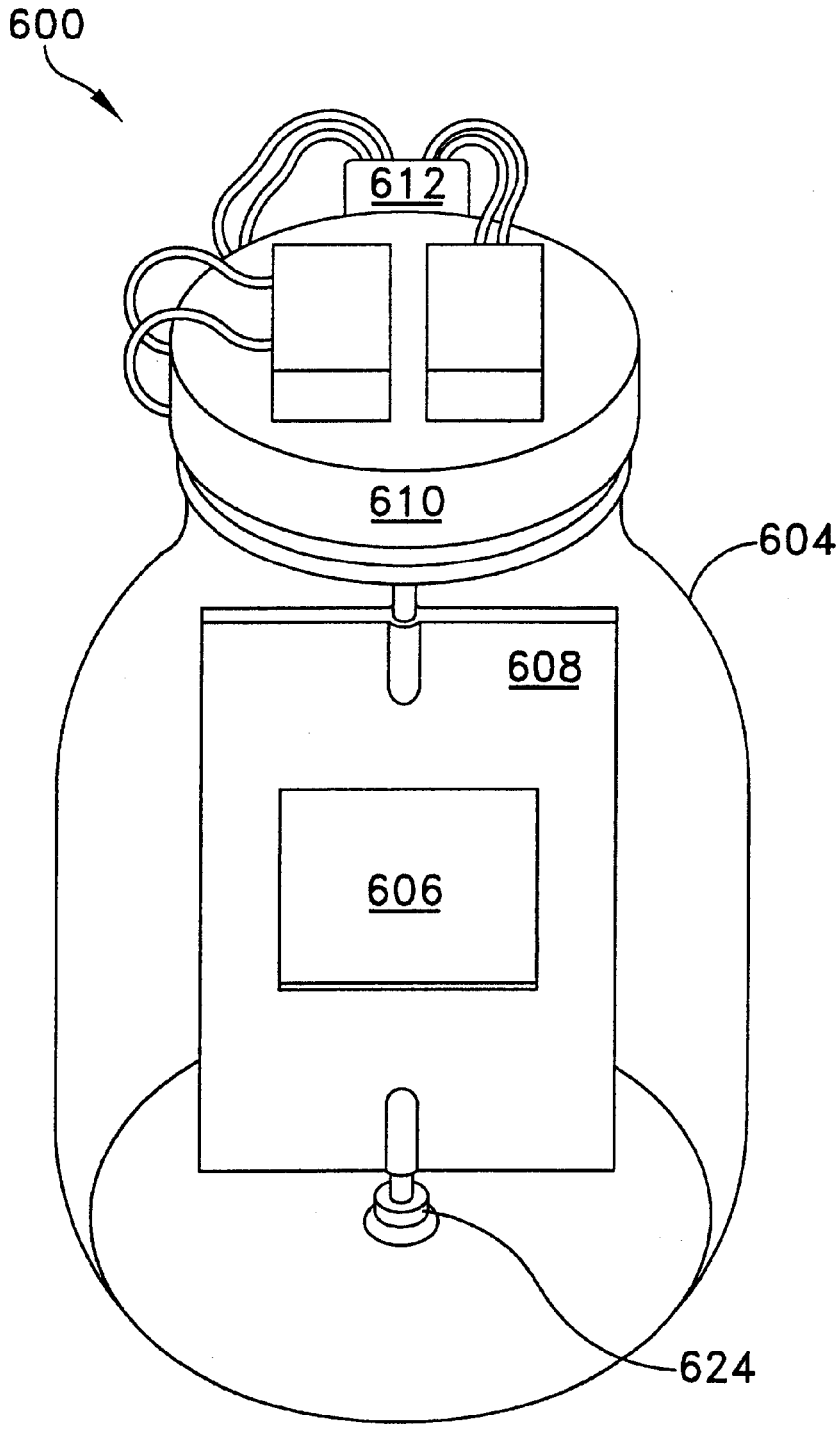
FIG. 12 is a perspective view of the viewing system of FIG. 8 in an assembled configuration.
Figure 13:
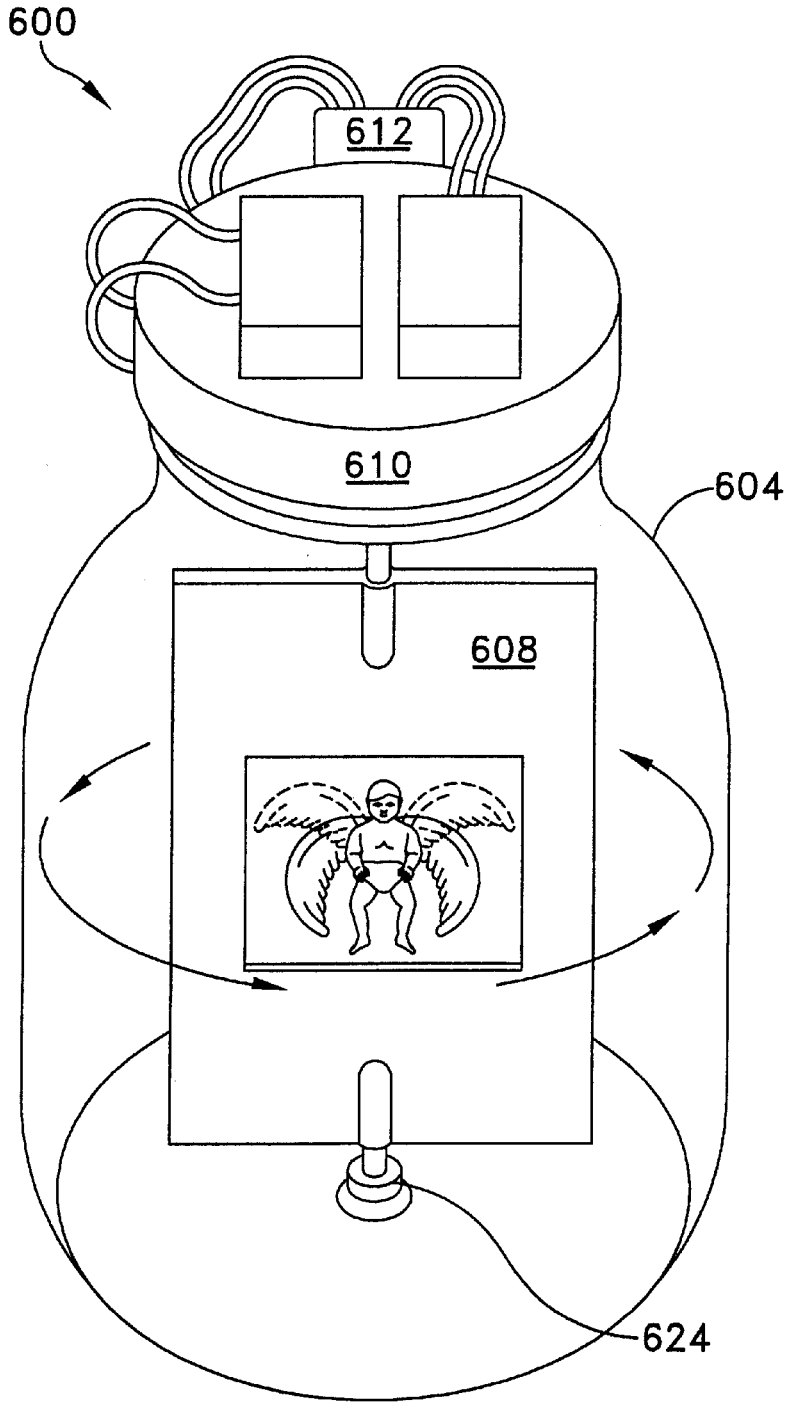
FIG. 13 is a perspective view illustrating the image displayed by the viewing system of FIG. 8 during operation.
Figure 14:
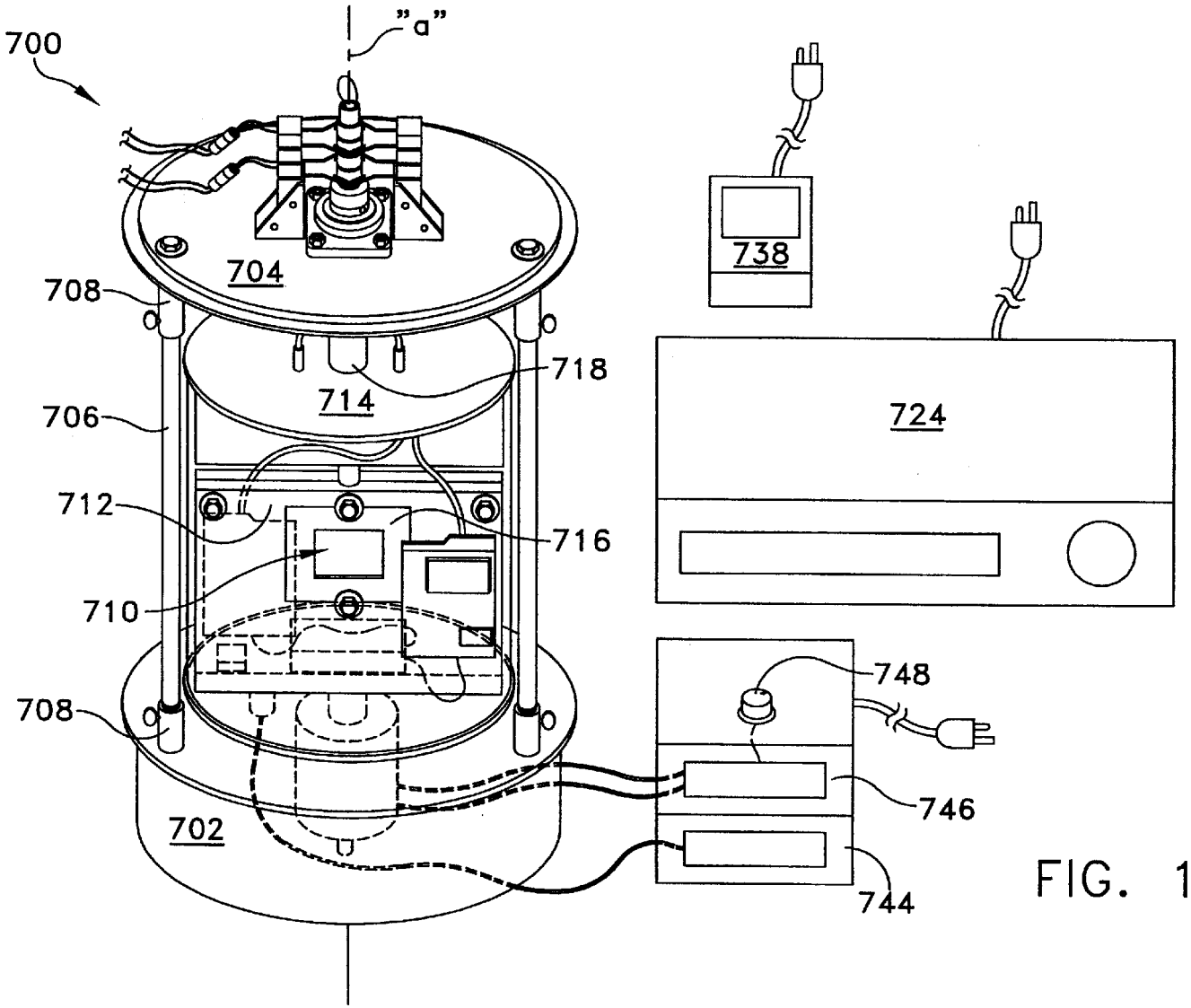
FIG. 14 is a perspective view of another embodiment of a viewing system which is a video viewing system.
Figure 15:
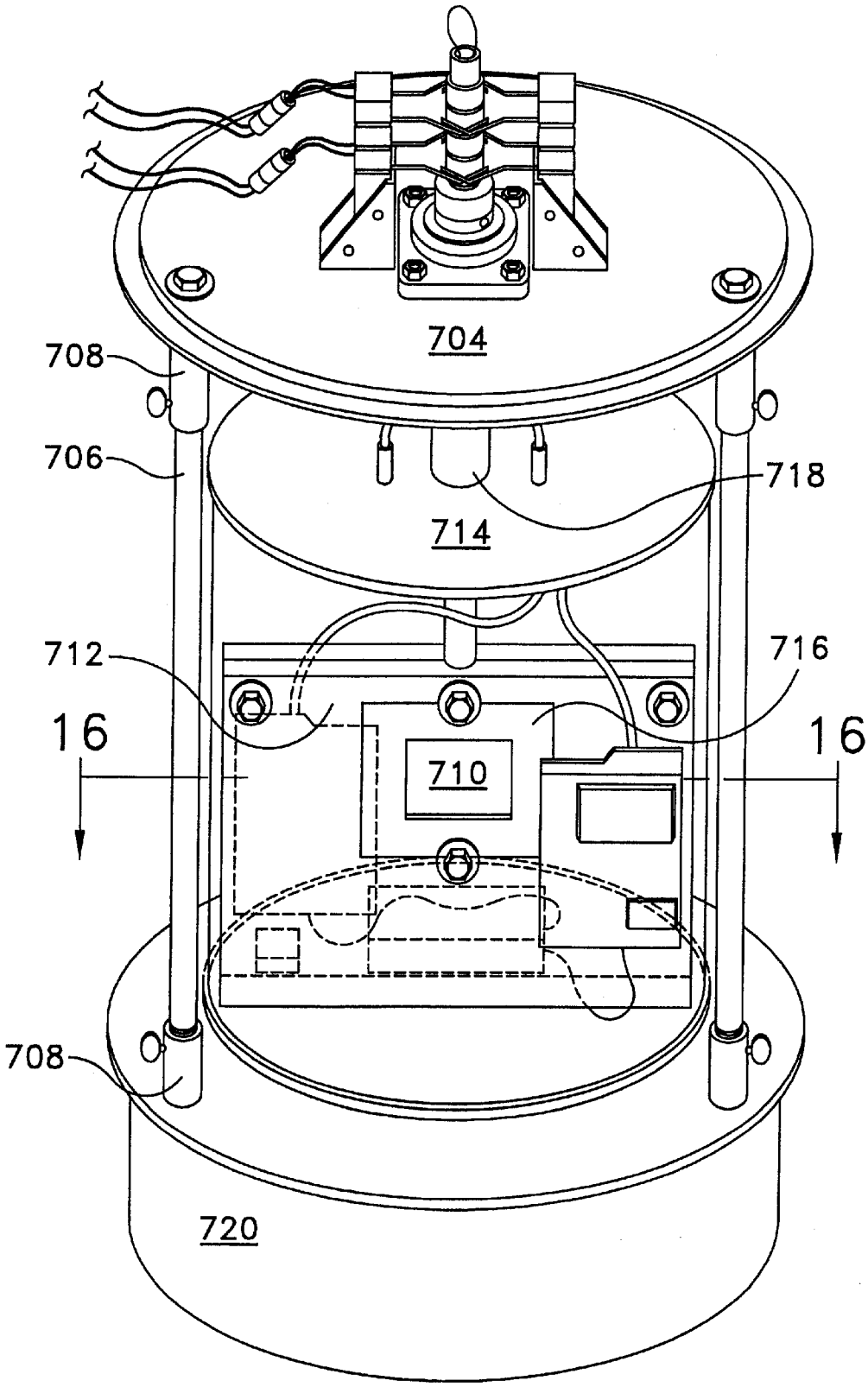
FIG. 15 is a perspective view of a portion of the system of FIG. 14.
Figure 16:
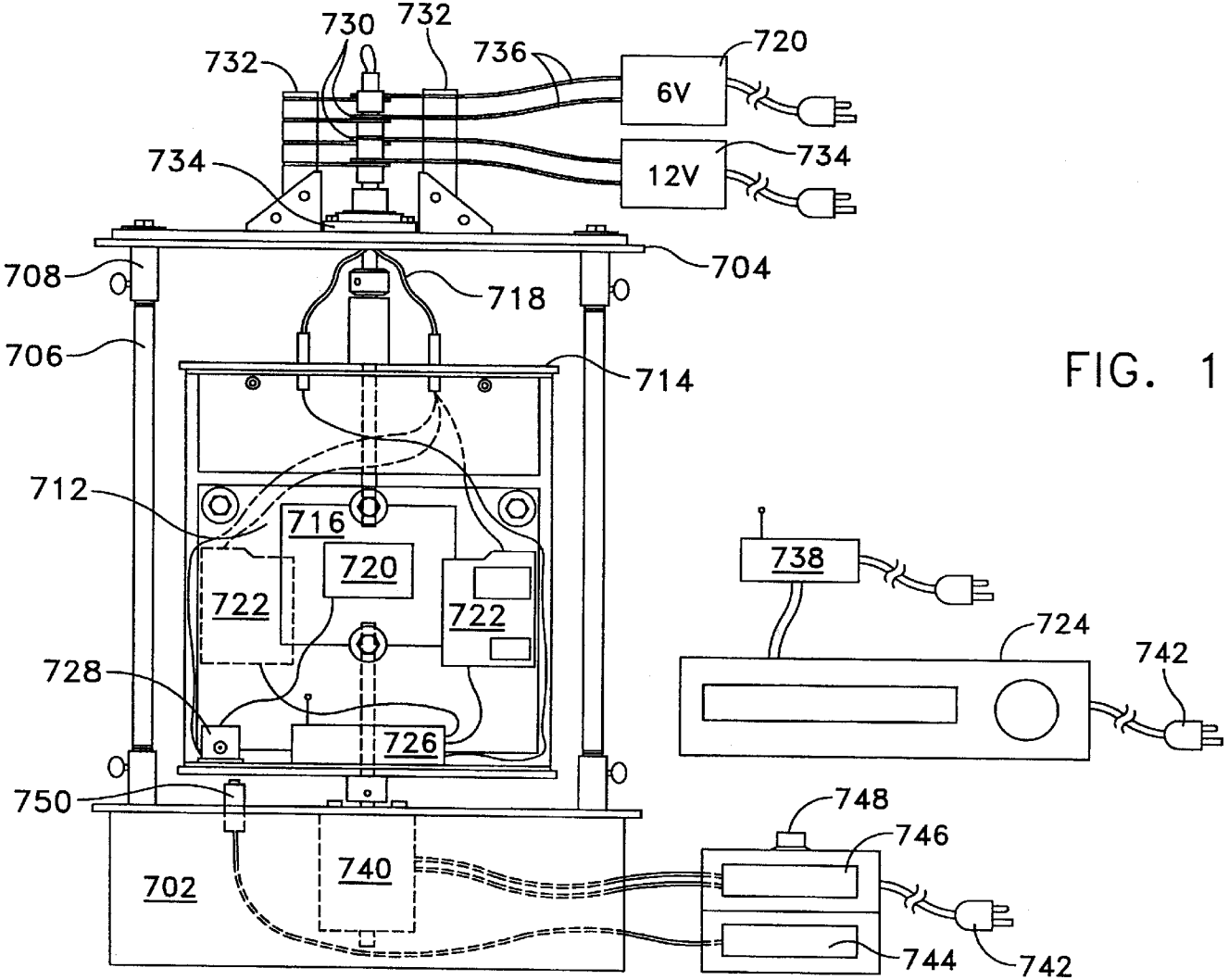
FIG. 16 is a side view of the system through line 16—16 of FIG. 15.
Figure 17:
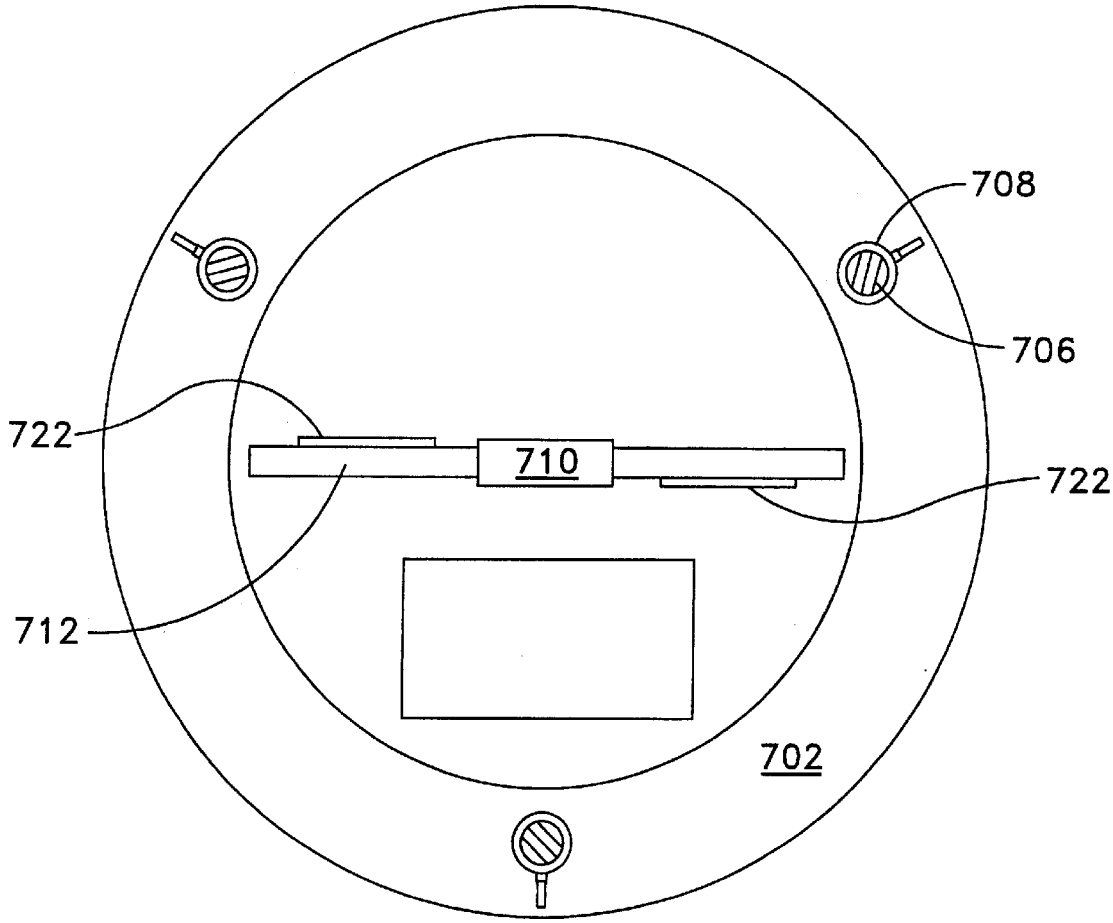
FIG. 17 is a top view of a viewing assembly that forms part of the viewing system shown in FIG. 14.

The image members were photographic transparencies disposed adjacent to and in direct contact with the light emitting surface of one of the ELPs. One of the photographic transparencies included an image of an angel with down-turned wings, as shown in FIG. 10. The other photographic transparencies included an image of the same angel with upturned wings, as shown in FIG. 11.

The blocking members were LCFs having a 48 degree viewing angle (available from 3M). The LCFs were disposed adjacent to and in direct contact with each of the photographic transparencies.

The ELPs, photographic transparencies, and LCFs were maintained in adjacent relation using clear, double-sided adhesive tape that was disposed about the perimeter of each of the illumination sources, image members, and blocking members.

In operation, the system was placed on a horizontal surface, such as table, and power to the motor was turned on, illuminating the ELPs and allowing the support rod and viewing assembly to rotate about axis "a." The image of the angel with its wings moving up and down could be seen from any position around the table, whether standing, sitting, or kneeling. Thus, the present example illustrates the effectiveness of the apparatus for simultaneously providing a visual display to any viewer within a 360 degree perimeter surrounding the viewing system.

Example 2

Another example of an exemplary viewing system 700 will be illustrated with reference to FIGS. 14–17, when taken together. The exemplary viewing system 700 of the present example was a video display system.

A support assembly that included a base 702 and a top surface 704 was used as a support. The base and top surface were spaced apart equidistantly by aluminum spacers 706 for support and stability. The spacers were directly connected to the opposing end plates by ½ inch aluminum post holders 708.

Viewing assembly 710 was disposed within a cast acrylic housing 712 supported by a hollow aluminum rod 718 between opposing end caps 714, and about which the viewing assembly was rotatable. Framing and supporting the viewing assembly 710 within the cast acrylic housing 712 was a two-sided ⅛ inch thick black plastic mounting surface 716. The viewing assembly 710 was the type illustrated in FIGS. 5A,B, and was disposed in an aperture (not illustrated) formed in the mounting surface 716. The aluminum rod extended through the center of each end cap 714, and through the base 702 and top surface 704 of the support assembly, but not through the viewing assembly. The viewing assembly 710 included two ELPs disposed back-to-back as the illumination source (available as product No. H90002W Proto-Kut Lamp from BKL Inc.), two 2.3 inch color LCD screens as the image members (available as Product No. 16-180 from Radio Shack), and the same blocking material used in Example 1.

Supported on the mounting surface 716, and rotatable with the viewing assembly, were two tuner/drivers 722 for the LCD (available as Catalog No. 16-180 from Radio Shack). Those of skill in the art will recognize that it is not necessary that these components must be positioned on the mounting surface. For example, it may be desirable to place these components in a separate housing in order to shield them from view.

Also contained within the housing were a wireless video receiver 726 (a 2.4 Ghz wireless A V distribution system available as Catalog No. 15-1971 from Radio Shack) connected to the LCD tuner/driver 722 by video wiring, and a −12 V inverter 728 (available as Item No. 15W5678 from Inverter Designs, Inc.) connected to the ELP. Those of skill in the art will recognize that these components may be positioned on the mounting surface, if desired.

A portion of the aluminum rod extended above the top surface 704 of the support assembly and was insulated with non-conductive PVC plastic tubing. Two sets of bronze ¼ inch×⅝ inch collector rings 730 were disposed about the nonconductive PVC plastic tubing that extended above the top surface 704. A plurality of nonconductive supports 732 were disposed on a 4 bolt center bearing mount 734 (available as Part No. VF4$208 from Browning). A plurality of bronze emitter wires 736 for conducting DC power to the collector rings 730, were wrapped about the collector rings 730 so as to contact the collector rings without hindering the free rotation of the viewing assembly. Non-conductive supports 732 extended to two separate DC power supplies 720, 734 each adapted to be plugged into a 120 volt AC electrical outlet. The first set of collector rings provided 6 volts of electricity to power the two tuner/LCD drivers. The second set of collector rings conducted 12 volts of DC power to the ELP inverter and the 2.4 GHS wireless Av receiver.

Peripheral to, but included in system 700 were a VCR 724 (available as Model No. VCH800U from Sharp), a 2.4 Ghz wireless video transmitter 738 (available as Catalog No. 15-1971 from Radio Shack), a variable speed DC motor 740 housed in base 702 (available as Model No. C0047 from Bodine), and a source of power 742. The motor included a separate speed control 744 (available as Model No. BC141 from Baldor) and a tachometer 746 (available as Model No. MP62TA from Red Lion Controls). A 10K potentiometer 748 was connected to the speed controller from adjusting the speed of the motor. A tachometer read-out 750 was also included (available as Model No. Ditak#5 Pt# DT500000 from Red Lion Controls). The variable speed control and tachometer readout were attached to the motor by conventional lead wires that extended through apertures (not illustrated) in the housing. The aluminum rod supporting the mounting surface was connected to the motor for providing rotation to the viewing assembly.

In operation, power to the motor was turned on, illuminating the ELPs and allowing the support rod and viewing assembly to rotate about axis "a." Power to the VCR and video transmitter were turned on, allowing the VCR to provide a video signal to the wireless video transmitter. The wireless video transmitter transmitted a video signal to the wireless video receiver, which in turn distributed the video signal to the video tuner, LCD driver and LCD screens. The scan rate of the LCD screens was 29.97 scans per second, and the rotation rate of the viewing assembly was about 29.97 revolutions per second.

A continuous moving video image could be seen from any position around the table, whether standing, sitting, or kneeling. Thus, the present example illustrates the effectiveness of the apparatus for simultaneously providing a video display to a plurality of viewers at any position orthogonal to, and from a plurality of positions oblique to, the axis on which the viewing assembly was rotated.

Example 3

The apparatus of Examples 1 and 2 were modified to include a polarizing filter as shown in FIG. 19 around the transparent housing. Thus, when the systems were in use, the polarizing filter masked from view any structures that might otherwise be viewed through the transparent housing.

Although particular embodiments of the invention have been described in detail for purposes of illustration, various changes and modifications may be made without departing from the scope and spirit of the invention. All combinations and permutations of the electrical contacts and operational methods are available for practice in various applications as the need arises. Accordingly, the invention is not to be limited except as by the appended claims.

What is claimed is:

1. A display system, comprising:

a viewing assembly, comprising a substantially planar and substantially continuous first image surface to display an image to one or more observers, a blocking member connected to the first image surface and disposed at one side of the first image surface, an illumination mechanism to illuminate the first image surface and disposed at an opposite side of the first image surface from the blocking member, and an interface to receive a signal, the signal including information that represents substance of the image; and a rotation mechanism to rotate the first image surface about a rotation axis at a speed sufficient to allow observers at multiple locations around the display system to see a substantially uninterrupted display of the first image surface.

2. The display system of claim 1, further comprising:

a second image surface to display the image, the second image surface disposed opposite the first image surface.

3. The display system of claim 1, wherein the blocking member and the first image surface having touching planar surfaces.

4. The display system of claim 3, wherein the first image surface and the illumination source have touching surfaces.

5. The display system of claim 1, wherein the first image surface and the illumination source have touching surfaces.

6. The display system of claim 1, wherein the signal is electronic.

7. The display system of claim 1, wherein the signal is a video signal.

8. The display system of claim 1, wherein the first image surface and the blocking member are substantially the same size.

9. The display system of claim 1, wherein the first image surface and the blocking member touch over a substantial portion of the first image surface.

10. A method of displaying a video image, the method comprising steps of:

providing a video display unit, the video display unit including a first image display surface to generate a display of an image, and a first blocking member disposed in proximity to the first image display surface;

rotating the video display unit about a rotation axis, the axis being in proximity to a center of the video display unit in a plane transverse to the rotation axis; and automatically altering the image generated by the video display unit in response to a signal, the altering step occurring during the rotating step.

11. The method of claim 10, wherein the first image display surface is substantially planar.

12. The method of claim 10, wherein the video display unit further includes:

a second image display surface, and a second blocking member disposed in proximity to the second image display surface.

13. The method of claim 12, further comprising a step of:

displaying on the image on the second image display surface.

14. A display system, comprising:

an image display assembly, to generate and display an image, the image display assembly having no more than two image display surfaces, each to display the image;

an interface to receive a signal to alter the image produced by the image display assembly;

a rotation mechanism to rotate the image display assembly about a rotation axis at a speed sufficient to allow observers around the display system to see a substantially uninterrupted display of the image.

15. The display system of claim 14, wherein the image display assembly has two image display surfaces, each being substantially planar.

16. The display system of claim 14, wherein the image display assembly comprises a blocking member.

17. The display system of claim 14, wherein the image display assembly comprises a light source in close proximity to the no more than two image display surfaces.

18. A display system, comprising:

an image surface to display an image;

an illumination source sized and shaped to substantially cover the image surface;

a blocking member disposed on a side of the image surface opposite the illumination source; and a rotation mechanism;

wherein the rotation mechanism is configured and positioned to rotate the image surface about an axis of rotation, the axis of rotation being in close proximity to the image surface in a plane transverse to the rotation axis.

19. The display system of claim 18, wherein:

the image surface has a width; and the axis of rotation is displaced from the image surface no more than the width of the image surface.

20. The display system of claim 18, wherein:

the illumination source and the image surface are touching.

* * * * *

UNITED STATES PATENT AND TRADEMARK OFFICE

CERTIFICATE OF CORRECTION

PATENT NO. : 6,801,185 B2
APPLICATION NO. : 09/834475
DATED : October 5, 2004
INVENTOR(S) : Neil B. Salley It is certified that error appears in the above-identified patent and that said Letters Patent is hereby corrected as shown below:

On the Title Page, Item (75), "Neil B. Salley" should read -- Neil B. Salley, Jr. --.

Signed and Sealed this

Twenty-sixth Day of August, 2008

JON W. DUDAS
*Director of the United States Patent and Trademark Office*